US008917155B2

(12) United States Patent
Adachi et al.

(10) Patent No.: US 8,917,155 B2
(45) Date of Patent: Dec. 23, 2014

(54) MAGNETIC COMPONENT

(71) Applicant: Denso Corporation, Kariya, Aichi-pref. (JP)

(72) Inventors: Hiroshi Adachi, Kariya (JP); Nobuhisa Yamaguchi, Nagoya (JP)

(73) Assignee: Denso Corporation, Kariya (JP)

( * ) Notice: Subject to any disclaimer, the term of this patent is extended or adjusted under 35 U.S.C. 154(b) by 24 days.

(21) Appl. No.: 13/757,043

(22) Filed: Feb. 1, 2013

(65) Prior Publication Data

US 2013/0200982 A1 Aug. 8, 2013

(30) Foreign Application Priority Data

Feb. 3, 2012 (JP) ..... 2012-22001
Dec. 5, 2012 (JP) ..... 2012-266730

(51) Int. Cl.

| | |
|---|---|
| ***H01F 27/36*** | (2006.01) |
| ***H01F 27/32*** | (2006.01) |
| ***H01F 38/12*** | (2006.01) |
| ***H01F 27/28*** | (2006.01) |

(52) U.S. Cl.

CPC ..... *H01F 27/365* (2013.01); *H01F 27/289* (2013.01)
USPC ..... 336/84 R; 336/84 C; 336/84 M

(58) Field of Classification Search

CPC ..... H01F 27/362; H01F 27/365; H01F 27/36; H01F 27/346; H01F 27/2804; H01F 17/0013; H01F 5/003; H01F 41/046; H01F 41/041
USPC ..... 336/84 R, 84 C, 84 M, 200, 198
See application file for complete search history.

(56) References Cited

U.S. PATENT DOCUMENTS

| | | | | |
|---|---|---|---|---|
| 7,859,382 | B2 * | 12/2010 | Koprivnak et al. | 336/200 |
| 2003/0030534 | A1 | 2/2003 | Gu et al. | |
| 2003/0095026 | A1 | 5/2003 | Kawanobe | |
| 2007/0152795 | A1 * | 7/2007 | Zeng et al. | 336/212 |
| 2009/0015362 | A1 * | 1/2009 | Okada et al. | 336/65 |
| 2009/0295528 | A1 * | 12/2009 | Silva et al. | 336/200 |
| 2010/0232181 | A1 * | 9/2010 | Nakahori | 363/17 |
| 2010/0289610 | A1 * | 11/2010 | Jacobson et al. | 336/84 C |

FOREIGN PATENT DOCUMENTS

| | | |
|---|---|---|
| JP | 61-156802 | 7/1986 |
| JP | 10-149929 | 6/1998 |
| JP | 2008-228419 | 9/2008 |

OTHER PUBLICATIONS

Office Action (2 pages) dated Apr. 30, 2014, issued in corresponding Japanese Application No. 2012-266730 and English translation (4 pages).

* cited by examiner

*Primary Examiner* — Elvin G Enad
*Assistant Examiner* — Kazi Hossain
(74) *Attorney, Agent, or Firm* — Nixon & Vanderhye P.C.

(57) ABSTRACT

A magnetic component includes a plurality of coils, a magnetic core, and a shield. The coils form at least one of a primary coil and a secondary coil to which a voltage corresponding to a voltage induced to the primary coil is induced. The magnetic core penetrates through the coils. The shield is disposed at least one of between different coils in the coils and between one or more of the coils and the magnetic core. Each of the coils and the shield are respectively pattern-formed on substrates. Each of the coils and the shield have a stacking structure.

21 Claims, 19 Drawing Sheets

MAGNETIC COMPONENT

CROSS REFERENCE TO RELATED APPLICATIONS

The present application is based on and claims priority to Japanese Patent Application No. 2012-22001 filed on Feb. 3, 2012 and No. 2012-266730 filed on Dec. 5, 2012, the contents of which are incorporated in their entirety herein by reference.

TECHNICAL FIELD

The present disclosure relates to a magnetic component including a plurality of coils, a magnetic core, and a shield.

BACKGROUND

A conventional magnetic component includes a plurality of coils, a magnetic core penetrating through the coils, and a shield disposed between different coils in the coils or between one or more of the coils and the magnetic core. The coils form at least one of a primary coil and a secondary coil to which a voltage depending on a voltage induced to the primary coil is induced.

Japanese Patent No. 4,503,223 (US 2003/030534 A1) discloses a magnetic component in which a shield is disposed between a primary coil and a secondary coil in a transformer. In the magnetic component, a magnetic core penetrating through the primary core and the secondary core are made of EE cores, and the shield is disposed between the EE cores.

In the above-described magnetic component, because the shield is interposed, a leakage flux from the magnetic core may increase. In a case where a part of the shield is removed so as not to generate a gap in the magnetic core, an electric shielding performance between the primary core and the secondary core may be reduced.

SUMMARY

It is an object of the present disclosure to provide a magnetic component that can improve a shielding effect.

A magnetic component according to an aspect of the present disclosure includes a plurality of coils, a magnetic core, and a shield. The coils form at least one of a primary coil and a secondary coil to which a voltage corresponding to a voltage induced to the primary coil is induced. The magnetic core penetrates through the coils. The shield is disposed at least one of between different coils in the coils and between one or more of the coils and the magnetic core. Each of the coils and the shield are respectively pattern-formed on substrates. Each of the coils and the shield have a stacking structure.

The magnetic component can restrict a flow of a displacement current between the coils and can improve a shielding effect.

BRIEF DESCRIPTION OF THE DRAWINGS

Additional objects and advantages of the present disclosure will be more readily apparent from the following detailed description when taken together with the accompanying drawings. In the drawings.

DETAILED DESCRIPTION

First Embodiment

Figure 1:
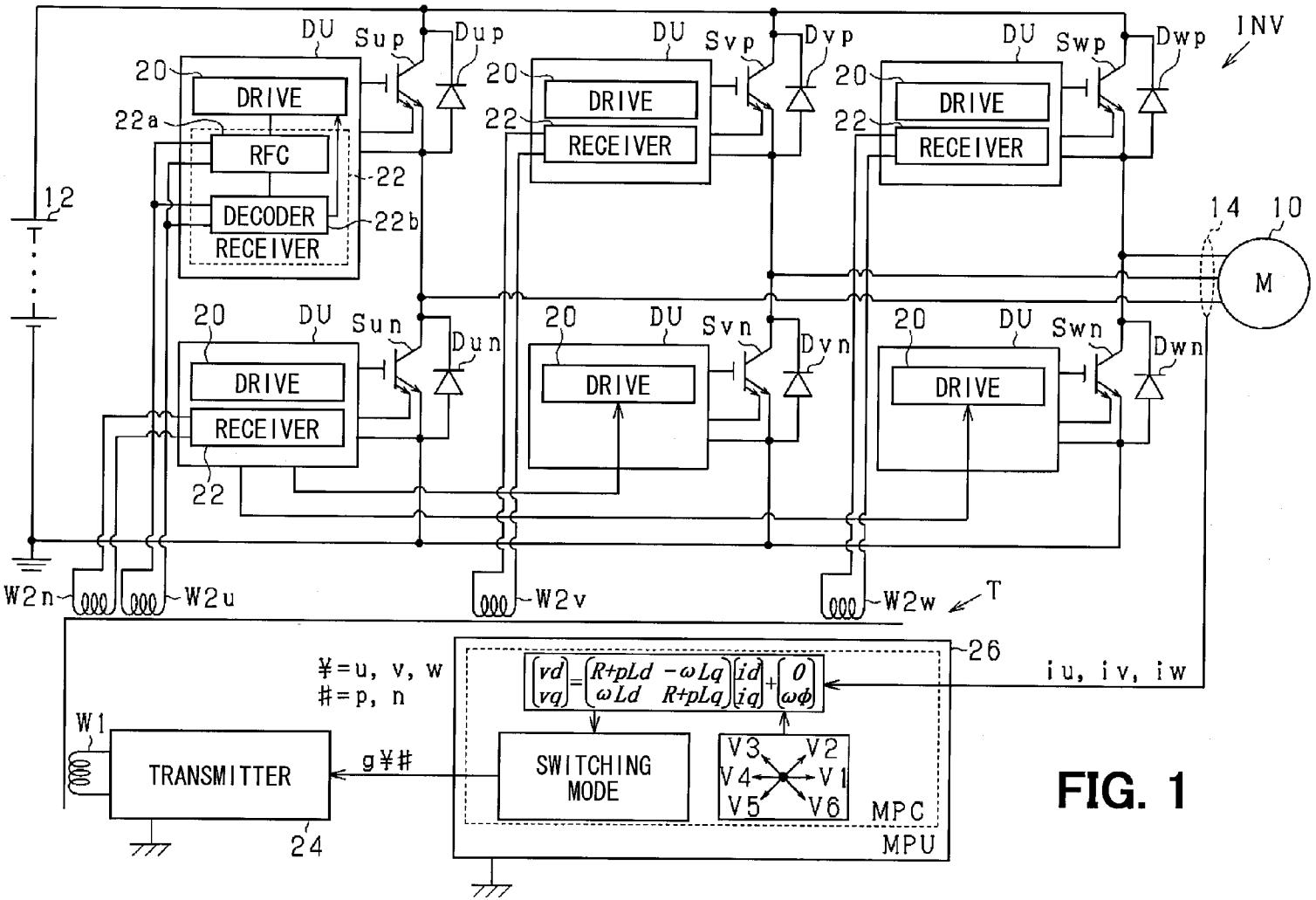
FIG. 1 is diagram showing a system according to a first embodiment of the present disclosure.

A magnetic component according to a first embodiment of the present disclosure will be described with reference to FIG. 1 to FIG. 5.

A motor generator 10 as an in-vehicle main engine is a three-phase rotating machine. The motor generator 10 is connected with a direct-current voltage source (high voltage battery 12) via an inverter INV. The high voltage battery 12 may be, for example, a secondary battery whose terminal voltage is greater than or equal to 100 V. A negative electrode potential of the high voltage battery 12 is set to be different from a vehicle body potential. In the present embodiment, a medium value of a positive electrode potential and the negative electrode potential of the high voltage battery 12 are set to be equal to the vehicle body potential by coupling a connection point of a plurality of capacitors (commonly known as Y capacitors) that divides a voltage of the high voltage battery 12 to a vehicle body.

The inverter INV includes three pairs of a high-potential side switching element S¥p (¥=u, v, w) and a low-potential side switching element S¥n connected in series. A connection point of the high-potential side switching element S¥p and the low-potential side switching element S¥n are connected to each terminal of the motor generator 10. The switching elements S¥# (¥=u, v, w: #=p, n) are respectively connected inverse-parallel with diodes D¥#.

A control terminal (gate) of each of the switching elements S¥# is connected with a corresponding drive unit DU. Each of the drive units DU includes a drive circuit 20 that controls a gate voltage of the corresponding switching element S¥#. Each of the drive units DU for the switching elements S¥p of an upper arm and the drive unit DU for the switching element Sun of a U-phase lower arm includes a reception unit 22 that receives an operation command for turning on and off the switching elements S¥#. The drive units DU for the switching elements Svn, Swn of V-phase and W-phase lower arms receive the signal received by the drive unit DU for the switching element Sun of the U-phase lower arm. The above-described setting is takes into account a fact that operation potentials of the drive units DU for the switching elements Sun, Svn, Swn of the lower arm are equal to each other.

An electric current that flows in the motor generator 10 is detected with a current sensor 14. Detection values, such as a detection value of the current sensor 14, required for controlling a control amount (e.g., torque) of the motor generator 10 are transmitted to a microprocessor unit 26. The microprocessor unit 26 is a software processing section in which a central processing unit executes a program stored in a memory.

The microprocessor unit 26 controls the electric current that flows in the motor generator 10 to a command current required for controlling the torque of the motor generator 10 to a command torque. A model predictive control (MPC) disclosed, for example, in JP-A-2008-228419 can be used. That is, an electric current is predicted for each case where a switching mode of the inverter INV is temporarily set, and a switching mode in which a difference between the predicted current and the command current is the smallest is employed. The switching modes are determined whether each of six switching elements S¥# (¥=u, v, w; #=p, n) of the inverter INV is on or off, and there are eight switching modes. The first to sixth switching modes respectively set an output voltage of the inverter INV to effective voltage vectors V1 to V6 shown in FIG. 1.

When the microprocessor unit 26 decides the switching mode, the microprocessor unit 26 transmits an operation signal g¥# of the switching element S¥# corresponding to the switching mode to a transmission unit 24. The operation signal g¥# basically expresses the switching mode. However, when the switching mode is changed, both of the operation signal g¥p of the upper arm and the operation signal g¥n of the lower arm are set to off command to express a dead time DT. The dead time DT is set based on a changing speed of a switching state of the switching elements S¥n so that both of the operation signal g¥p of the upper arm and the operation signal g¥n of the lower arm are not on when the switching mode is changed.

The transmission unit 24 encodes the operation signal g¥# transmitted from the microprocessor unit 26 with a digital baseband code (Manchester code). Then, the transmission unit 24 applies a voltage to the primary coil W1 of the transformer T in accordance with a pulse signal which is the encoded signal. Accordingly, a pulse voltage signal is transmitted to each of the secondary coils W2*n*, W2*u*, W2*v*, W2*w* of the transformer T.

The secondary coil W2*n* is connected with the reception unit 22 disposed in the drive unit DU of the switching element Sun of the U-phase lower arm. The secondary coils W2*u, v, w* are respectively connected with the reception units 22 disposed in the drive units DU of the switching elements Sup, Svp, Swp of the U, V, W-phase upper arms.

As described in the U-phase upper arm, each of the reception unit 22 includes a rectifier circuit 22*a* and a decoder 22*b*. The rectifier circuit 22*a* rectifies an output power of the secondary coil W2*u* to provide a power source of the drive circuit 20 and the decoder 22*b*. The decoder 22*b* decodes the pulse signal induced to the secondary coil W2*u* to generate the on/off command of the corresponding switching element Sup and outputs the on/off command to the drive circuit 20.

Figure 2:
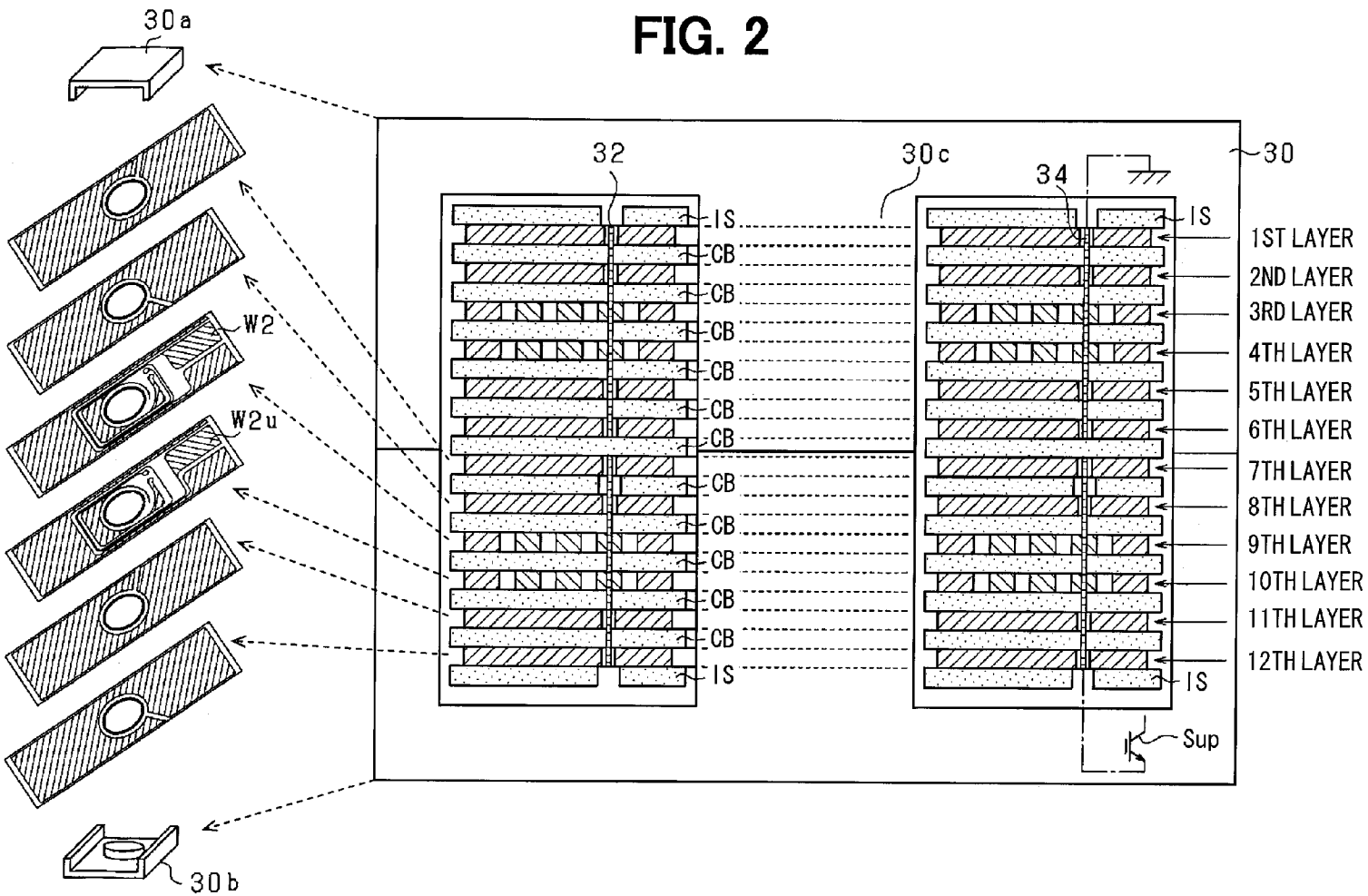
FIG. 2 is a diagram showing a cross-sectional structure of a transformer according to the first embodiment.

FIG. 2 is a diagram showing a cross-sectional configuration of the transformer T. In the present embodiment, the transformer T is an example of a magnetic component. In FIG. 2, only a part in which the primary coil W1 and the secondary coil W2*u* of the U-phase upper arm are magnetically connected is illustrated, and parts corresponding to the secondary coils W2*n*, W2*v*, W2*w* are not illustrated because of space limitations. Thus, the actual transformer T according to the present embodiment further includes three groups of components same as the components corresponding to the secondary coil W2*u* in FIG. 2.

As shown in FIG. 2, the transformer T include a magnetic core 30 formed of an EE core. The primary coil W1, the secondary coil W2*u* and the like are formed of conductive patterns in a multilayer substrate penetrated by a center pole 30*c* of the magnetic core 30. In FIG. 2, a first layer to sixth layer are components corresponding to the primary coil W1, and a seventh layer to a twelfth layer are components corresponding to the secondary coil W2*u*. Each of the layers is formed of a pattern in the multilayer substrate. Each of the layers has a rectangular shape having a long side and a short side in a plane as shown in a left side of FIG. 2.

Figure 3:
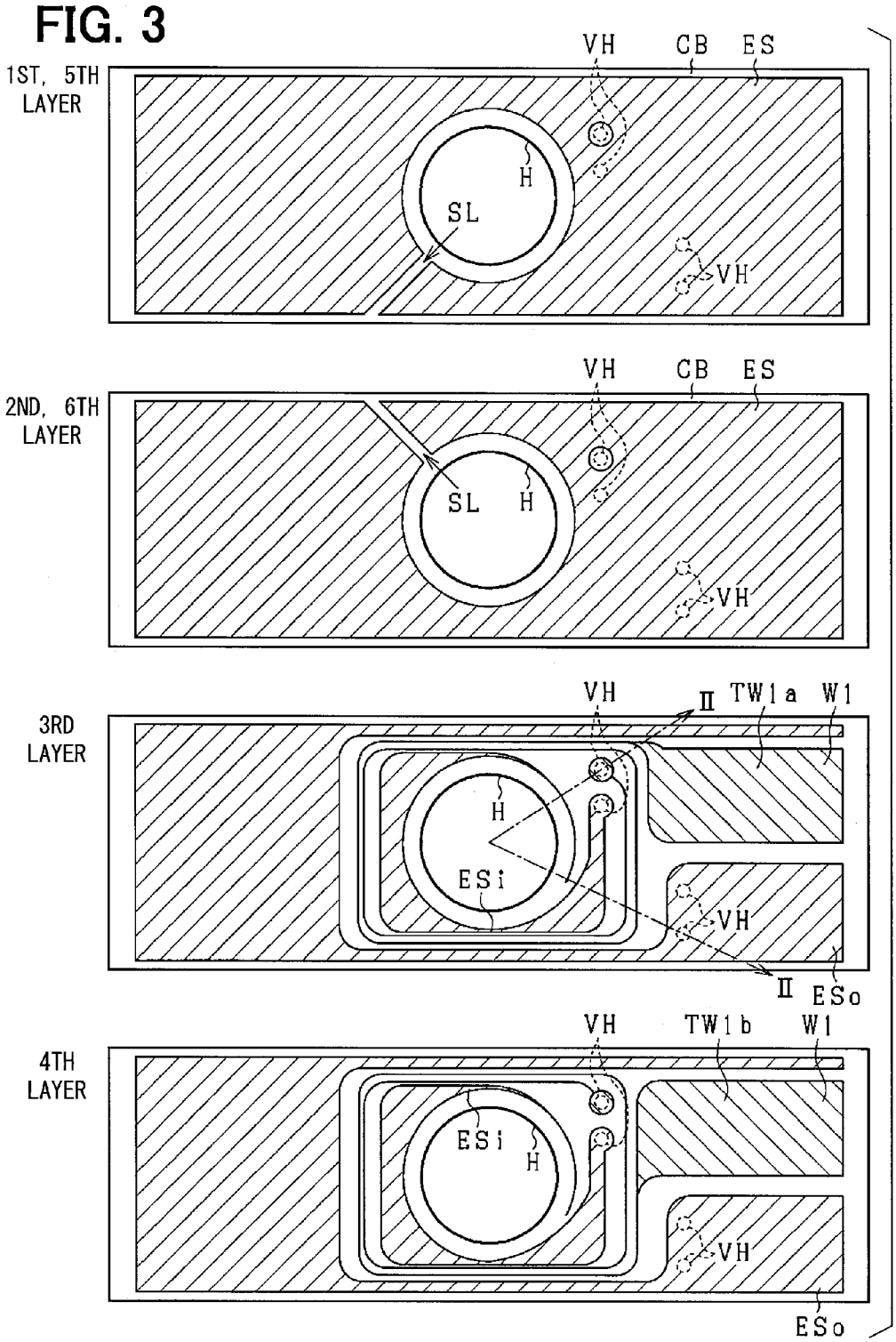
FIG. 3 is a diagram showing a plan view of each layer in the transformer according to the first embodiment.

FIG. 3 is a diagram showing a plan view of the first to sixth layers. Patterns of the seventh to twelfth layer respectively correspond to patterns of the first to seventh layers. However, in cases where the primary coil W1 and the secondary coil W2*u* have different number of turns, the patterns of the secondary coil W2*u* formed in the ninth layer and the tenth layer are different from the patterns in the third layer and the fourth layer. The patterns in the other layers are the same between the primary coil W1 and the secondary coil W2*u* in the light of mass production. Patterns corresponding to each of the secondary coils W2*n*, W2*v*, W2*w* are formed of six layers, and the patterns have the same shape as the patterns shown in FIG. 3 for the sake of convenience, except for shapes of the secondary coils W2*n*, W2*v*, W2*w* themselves.

As shown in FIG. 3, a substrate CB defines a hole H at a center portion. The hole H is penetrated by the center pole 30*c* of the magnetic core C shown in FIG. 2. The patterns of the primary coil W1 are formed on adjacent two layers and are connected with each other through conductor that formation portions of vias VH shown by dashed lines. Accordingly, the primary coil W1 is connected with a terminal TW1*a* formed on a side surface of the substrate CB on the third layer, circles around the hole H, and is connected with the pattern on the fourth layer through the conductor that fills the via VH. The pattern circles around the hole H and is connected with a terminal TW1*b* formed at an end portion of the substrate CB.

The primary coil W1 is formed with the two layers so as to increase the number of turns while restricting increase of an area of the substrate.

On either side of the layers that form the primary coil W1, a pair of layers on which a partial shield (shield ES) is pattern-formed is provided. The shield ES restricts flow of a displacement current between the primary coil W1 and the secondary coils W2*n*, W2*u*, W2*v*, W2*w*, and restricts flow of a displacement current in the magnetic core 30.

The shield ES formed on the first layer (the fifth layer) and the second layer (the sixth layer), which are the pair of layers, defines a slit SL around the hole H so as to form an open loop in consideration of the fact that a voltage is induced to the shield ES due to a change in magnetic flux of the center pole 30*c*. When the shield ES has the open loop structure, even if the voltage is induced due to the change in magnetic flux, an electric current due to the induced voltage does not flow.

Figure 4:
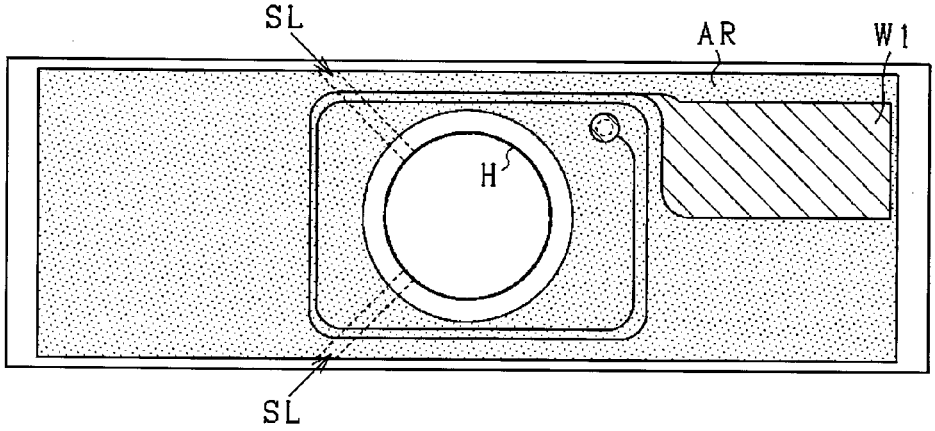
FIG. 4 is a diagram for explaining a meaning of a stacking structure of shields according to the first embodiment.

The slit SL has a stripe shape extending in a radial direction from an axis (the center pole 30*c*) of the primary coil W1. Angles at which the slits SL are formed are different between the first layer (the fifth layer) and the second layer (the sixth layer), which are the pair of layers to improve an effect of the shield ES, that is, an effect of shielding an electric field and the like. In FIG. 4, a region AR is defined by projecting the shields ES, which are pattern-formed to the first layer (the fifth layer) and the second layer (the sixth layer), onto the substrate CB, on which the primary coil W1 is pattern-formed. The region AR includes the primary coil W1. Accordingly, the effect of shielding the electric field and the like can be improved.

As shown in FIG. 3, in the layer in which the primary coil W1 is pattern-formed, an outer peripheral shield ESo is pattern-formed along an outer periphery of the primary coil W1. The outer peripheral shield ESo has an open loop structure so that an electric current does not flow into the outer peripheral shield ESo due to the voltage induced by a change in magnetic flux of the center pole 30*c*.

On the layer on which the primary coil W1 is pattern-formed, an inner peripheral shield ESi is also pattern-formed along an inner periphery of the primary coil. The inner peripheral shield ESi has an open loop structure so that an electric current does not flow into the inner peripheral shield ESi due the voltage induced by a change in magnetic flux of the center pole 30*c*. The inner peripheral shield ESi is configured as follows to improve the shielding effect.

Figure 5:
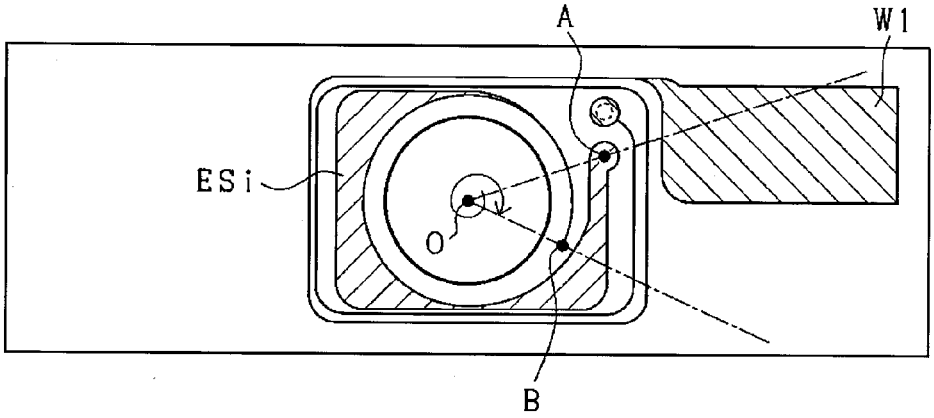
FIG. 5 is a diagram for explaining a structure of an inner peripheral shield according to the first embodiment.

As shown in FIG. 5, the open loop of the inner peripheral shield ESi has an end portion A and an end portion B. When a displacement point displaces from the end portion A to the end portion B, a rotation angle of a half line extending from an axis O of the primary coil W1 to the displacement point, which is shown by dashed-dotted lines, is greater than 360 degrees. Accordingly, the shielding effect can be improved while forming the open loop.

The shields ES, the outer peripheral shield ESo, and the inner peripheral shield ESi, which are provided corresponding to the primary coil W1, are connected each other through the conductor filling in the vias VH. In FIG. 3, the shields ES are connected through the conductor filling in three vias VH as an example. One of the three is connected with the inner peripheral shield ESi, and the other two are connected with the outer peripheral shield ESo.

In FIG. 3, one of the vias VH is not is in contact with the shields ES. This is a hole for providing the via VH being in contact with the pattern of the primary coil W1. In the above-described structure, the vias VH are filled with the conductor after the first to sixth layers are stacked. Accordingly, the pattern of the primary coil W1 formed on the third layer can be connected with the pattern of the primary coil W1 formed on the fourth layer. In FIG. 2, a cross-sectional view taken along line II-II in the third layer in FIG. 3 is shown. Although a conductor 32 penetrates the first to sixth layers, the conductor 32 is not connected with the first layer, the second layer, the fifth layer, and the sixth layer.

On the other hand, all the shields ES, the outer peripheral shield ESo, and the inner peripheral shield ESi are connected through a conductor 34 as shown in FIG. 2.

Although the conductor 34 is set to the reference potential (the vehicle body potential) of the transmission unit 24 and the microprocessor unit 26 in FIG. 2, an end portion of the outer peripheral shield ESo or an end portion of the shield ES may be connected with the vehicle body.

In FIG. 2, a potential of the shields ES and the like formed on the first to sixth layers corresponding to the primary coil is set to the ground potential (the vehicle body potential) and a potential of the shields ES and the like formed on the seventh to twelfth layers corresponding to the secondary coil is set to the potential of the emitter terminal of the switching element Sup. Similarly, the potentials of the shields ES and the like corresponding to the secondary coils W2*n*, W2*v*, W2*w* are respectively set to the potentials of the emitter terminals S¥n, Svp, Swp.

Accordingly, a displacement current does not flow between the transmission unit 24 and the reception unit 22 due to a change in potential difference between the primary coil W1 and the secondary coils W2*n*, W2*u*, W2*v*, W2*w*. In other words, a stray capacitance is normally provided between the primary coil W1 and the secondary coils. When the stray capacitance between the primary coil W1 and the secondary coils is expressed as C and a change in potential difference between the primary coil W1 and the secondary coil is expressed as ΔV, if the shield is not provided, a displacement current of $C \cdot \Delta V/\Delta t$ flows between the primary coil W1 and the secondary coil. The change in potential difference ΔV is about the terminal voltage of the high voltage battery 12 when the switching element S¥n of the lower arm is turned from on to off and the switching element S¥# of the upper arm is turned from off to on. Because the change in potential difference ΔV is generated in the changing time ΔT of the switching state, which is a very short time, the displacement current calculated as $C \cdot \Delta V/\Delta t$ becomes large.

In the present embodiment, an influence of a change in potential of one of adjacent coils to the other can be restricted by providing the shields ES. Especially, in the present embodiment, the potential of the shields ES are set to the reference potential of the corresponding coil. Specifically, the potential of the shields ES corresponding to the primary coil W1 are set to the reference potential of an output section (the transmission unit 24). The potential of the shields ES corresponding to the secondary coil W2*n* are set to the reference potential (the emitter potential of the switching element S¥n) of a drive section (the drive unit DU) of the switching element S¥n of the lower arm. Furthermore, the potential of the shields ES corresponding to the secondary coil W2¥ (¥=u, v, w) are set to the reference potential (the emitter potential of the switching element S¥p) of the drive unit DU of the switching element S¥p of the upper arm. Accordingly, even when the emitter potential of the switching element S¥p of the upper arm changes, a potential difference is not generated between the shields ES corresponding to the secondary coils W2*u*, W2*v*, W2*w*. Accordingly, a displacement current does not flow from the secondary coils W2*u*, W2*v*, W2*w* to the corresponding shields ES.

The shield ES disposed between the magnetic core 30 and the coil closest to the magnetic core 30 is provided for restricting a flow of a displacement current to the magnetic core 30. For example, when the twelfth layer in FIG. 2 and the magnetic core 30 are in contact with each other through an insulation layer (an insulation sheet IS) and the secondary coil W2*u* is formed on the ninth and tenth layers, the shields ES on the eleventh and twelfth layers restrict a flow of a displacement current to the magnetic core 30. If the shields ES are not formed on the eleventh and twelfth layer, a displacement current flows from the secondary coil W2*u* to the magnetic core due to a change in potential of the switching element Sup. Furthermore, when the potential of the magnetic core 30 is not fixed, for example, to the ground, the primary coil may be influenced by the electric field.

Similarly, the inner peripheral shield ESi and the outer peripheral shield ESo are provided for restricting a flow of a displacement current to the magnetic core 30.

The potential difference between the primary coil W1 and the secondary coil W2*n* does not drastically changes. Thus, when the primary coil W1 and the secondary coil W2*n* are disposed adjacent to each other, the shield ES between the primary coil W1 and the secondary coil W2*n* may correspond only one of the primary coil W1 and the secondary coil W2*n*. However, in the present embodiment, the patterns of the shields ES, the outer peripheral shield ESo, and the inner peripheral shield ESi corresponding to each coil are set to be the same as much as possible so as to simplify mass production. Although the shield between the one layer of the primary coil W1 and the magnetic core 30 may be omitted when another coil is not interposed, the present embodiment prioritizes a simplification of mass production.

Second Embodiment

A second embodiment of the present disclosure will be described with reference to FIG. 6, FIG. 7A and FIG. 7B with a focus on differences from the first embodiment.

Figure 6:
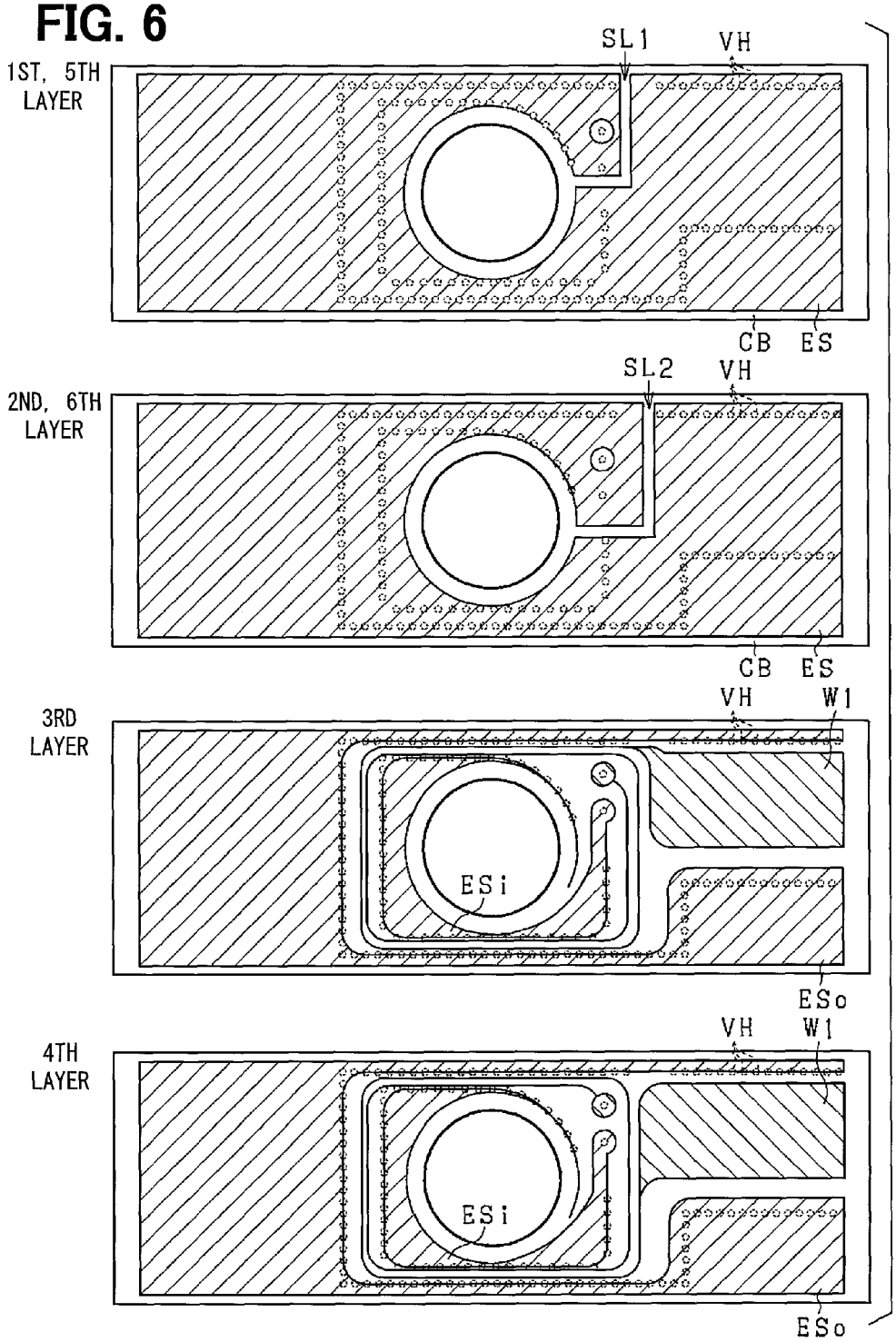
FIG. 6 is a diagram showing a plan view of each layer in a transformer according to a second embodiment of the present disclosure.
Figure 7A:
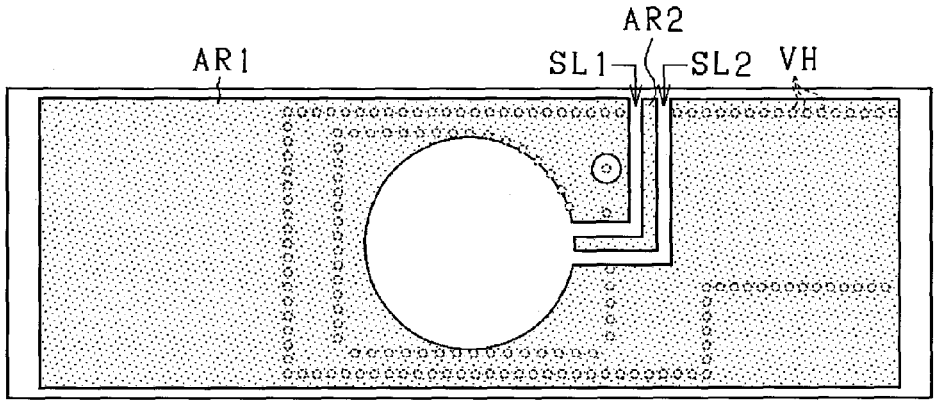
FIG. 7A and FIG. 7B are diagrams for explaining a forming method of vias according to the second embodiment.
Figure 7B:
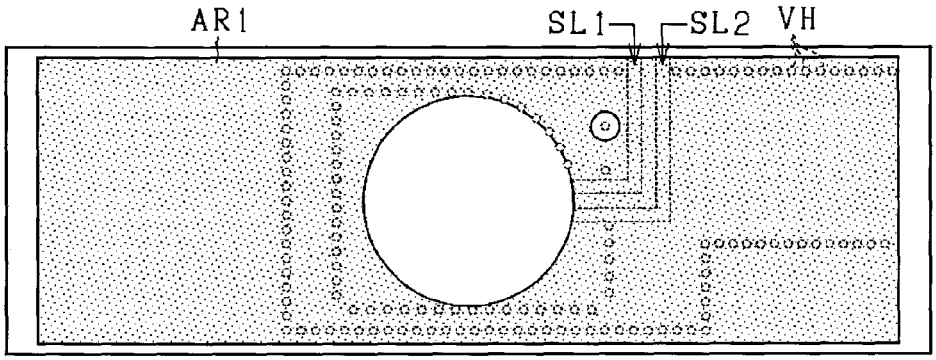

As shown in FIG. 6, shields ES and the like according to the present embodiment have difference shapes from the shields ES and the like according to the first embodiment. In the present embodiment, conductor filling in a plurality of vias VH make connections between outer peripheries of the shields ES, between the shield ES and the inner peripheral shield ESi, and between the shield ES and the outer peripheral shield ESo. The patterns on the different layers are connected with each other through the conductor filling in the vias VH in order to simply a production process. The connections are made to improve a shielding effect. It is preferable to set a distance between conductors connecting different layers to be small.

It should make sure that the connected shields do not form a closed loop. In the present embodiment, only one of regions AR1, AR2 shown in FIG. 7A is a connection allowable region in which the connection by the conductor filling in the vias VH is allowable so that the shield has the open loop structure. The regions AR1, AR2 are defined by removing regions defined by projecting slits SL1, SL2 of the first layer and the second layer (the fifth layer and the sixth layer) onto a region where the primary coil W1 is formed from a regions defined by projecting the shields ES of the first layer and the second layer (the fifth layer and the sixth layer) onto the region where the primary coil W1 is formed. Because the project regions of the slits SL1, SL2 of the first layer and the second layer (the fifth layer and the sixth layer) do not overlap each other, the region defined by removing the projected regions of the slits SL1, SL2 become a plurality of regions AR1, AR2. Thus, by forming the vias VH at either one of the regions AR1, AR2, the open loop structure can be provided.

In order to form the open loop structure, all the partial shields (the shields ES on the first layer, the second layer, the fifth layer, and the sixth layer) connected by the conductor filling in the vias VH, and the inner peripheral shield ESi and the outer peripheral shield ESo on the third layer and the fourth layer have limitations. Because the shields ES on the first layer and the second layer are the same as the shields ES on the fifth layer and the sixth layer, a condition for forming the open loop is satisfied by having only the connection allowable region shown in FIG. 7A. With regard to the inner peripheral shield ESi and the outer peripheral shield ESo, as is known from FIG. 6, because a connection across the region AR2 shown in FIG. 7A is not provided, the open loop structure of the shield can be provided.

In the present embodiment, the region AR1 is set to the connection allowable region so that vias VH surround the coil as much as possible and the shielding effect is improved. Accordingly, as shown in FIG. 6, the vias VH surround the coil (the primary coil W1) as much as possible.

Third Embodiment

A third embodiment will be described with reference to FIG. 8 with a focus on differences from the first embodiment.

In the present embodiment, a transformer T is formed of a plurality of flexible printed board.

Figure 8:
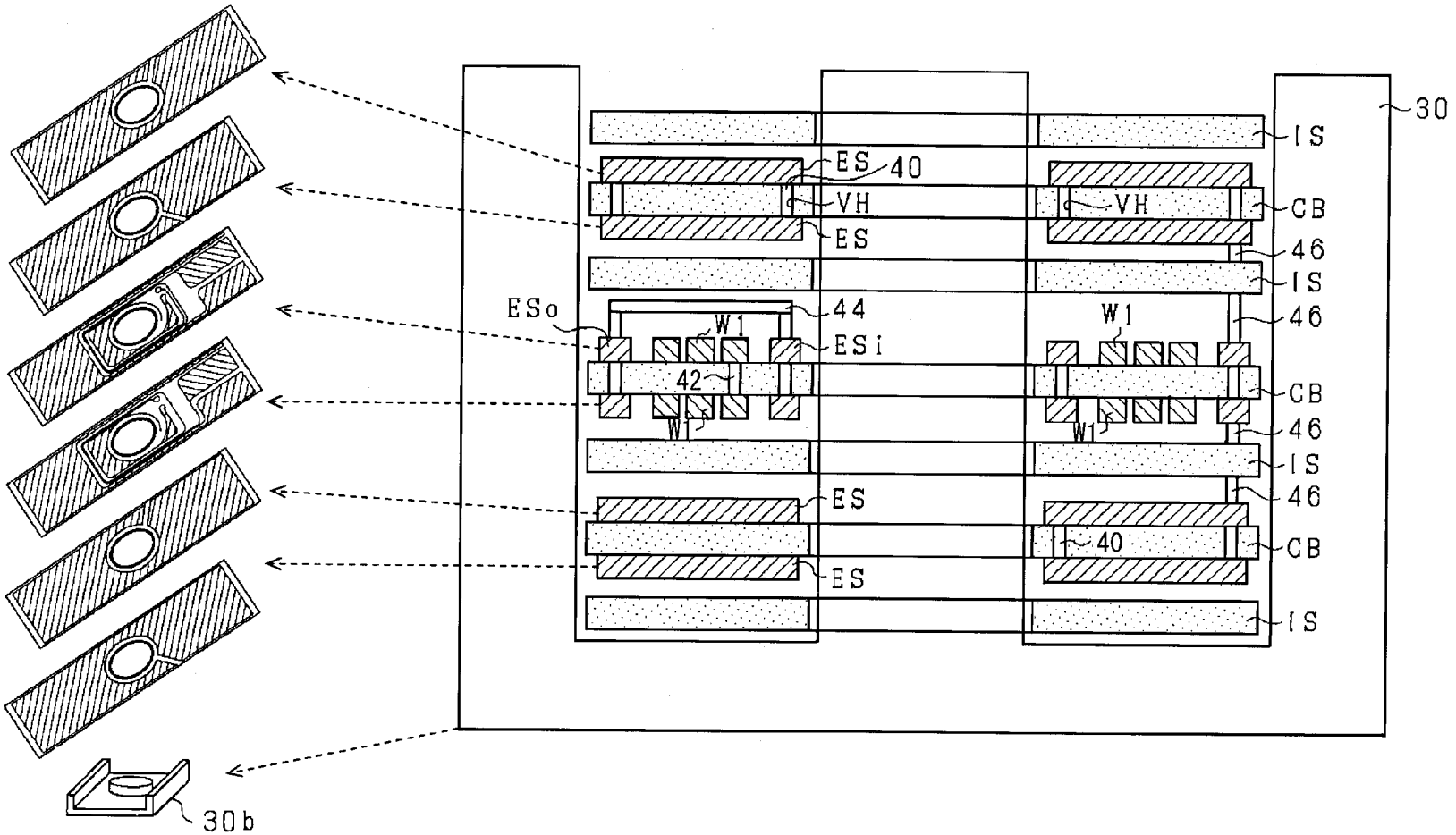
FIG. 8 is a diagram showing a cross-sectional structure of a transformer according to a third embodiment of the present disclosure.

A part of the transformer T corresponding to the primary coil W1 is shown in FIG. 8. A substrate CB shown in FIG. 8 is double-sided substrate formed of a flexible printed board. Between the substrate CB and the substrate CB, an insulation sheet IS is disposed. Although a clearance is illustrated between the substrate CB and the insulation sheet IS in FIG. 8, it is for the sake of convenience. Actually, the substrate CB and the insulation sheet IS are overlaid each other.

In the present embodiment, the shields ES formed on different substrates CB, and the shield ES and the outer peripheral shield ESo are connected through an external connection conductor 46 different from a pattern of the substrate CB. In addition, the outer peripheral shield ESo and the inner peripheral shield ESi are connected through an external connection conductor 44.

Fourth Embodiment

A fourth embodiment of the present disclosure will be described with reference to FIG. 9 with a focus on differences from the first embodiment.

Figure 9:
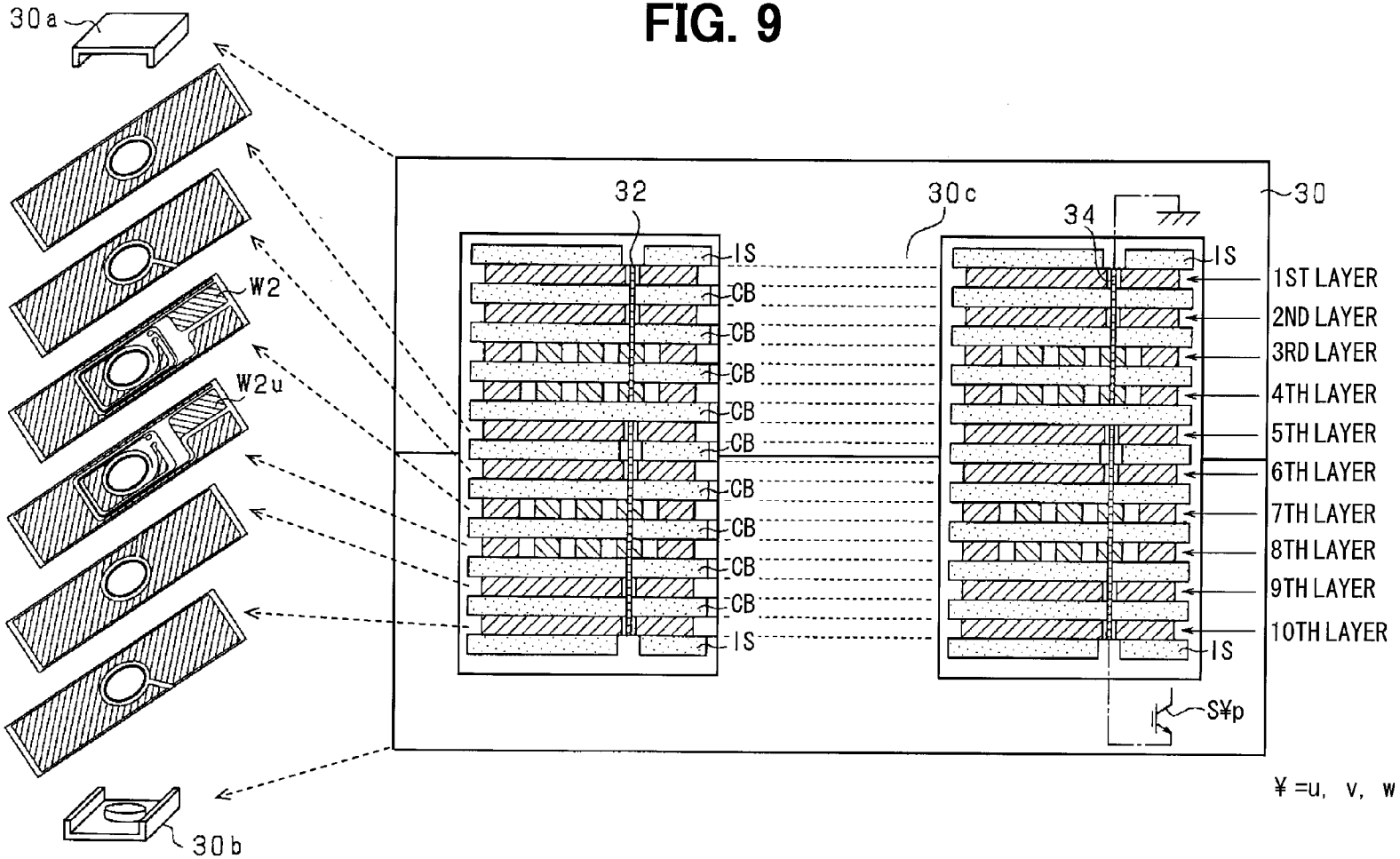
FIG. 9 is a diagram showing a cross-sectional structure of a transformer according to a fourth embodiment of the present disclosure.

In FIG. 9, components corresponding to the components shown in FIG. 2 are indicated by the same reference mark for the sake of convenience.

In the present embodiment, the secondary coil W2 corresponding to the high-potential side switching element S¥p is disposed adjacent to the primary coil W1. A shield ES corresponding to the primary coil W1 is disposed only a side adjacent to the magnetic core 30 and is not disposed on a side adjacent to the secondary coil W2¥. In FIG. 9, the fifth layer and the sixth layer shown in FIG. 2 are deleted.

In the present case, the shield ES between the primary coil W1 and the secondary coil W2¥ adjacent to the primary coil W1 is fixed to the emitter potential of the switching element S¥p corresponding to the secondary coil W2¥ adjacent to the primary coil W1. Thus, a displacement current flows from the primary coil W1 to the shield ES. However, even in this case, because of the shield ES, the displacement current does not flow between the primary coil W1 and the secondary coil W2¥.

Fifth Embodiment

A fifth embodiment of the present disclosure will be described with reference to FIG. 10, FIG. 11, FIG. 12A and FIG. 12B with a focus on differences from the third embodiment.

In the present embodiment, shapes of patterns formed on flexible printed boards are different from the shapes of the patterns formed on the flexible printed boards according to the third embodiment.

Figure 10:
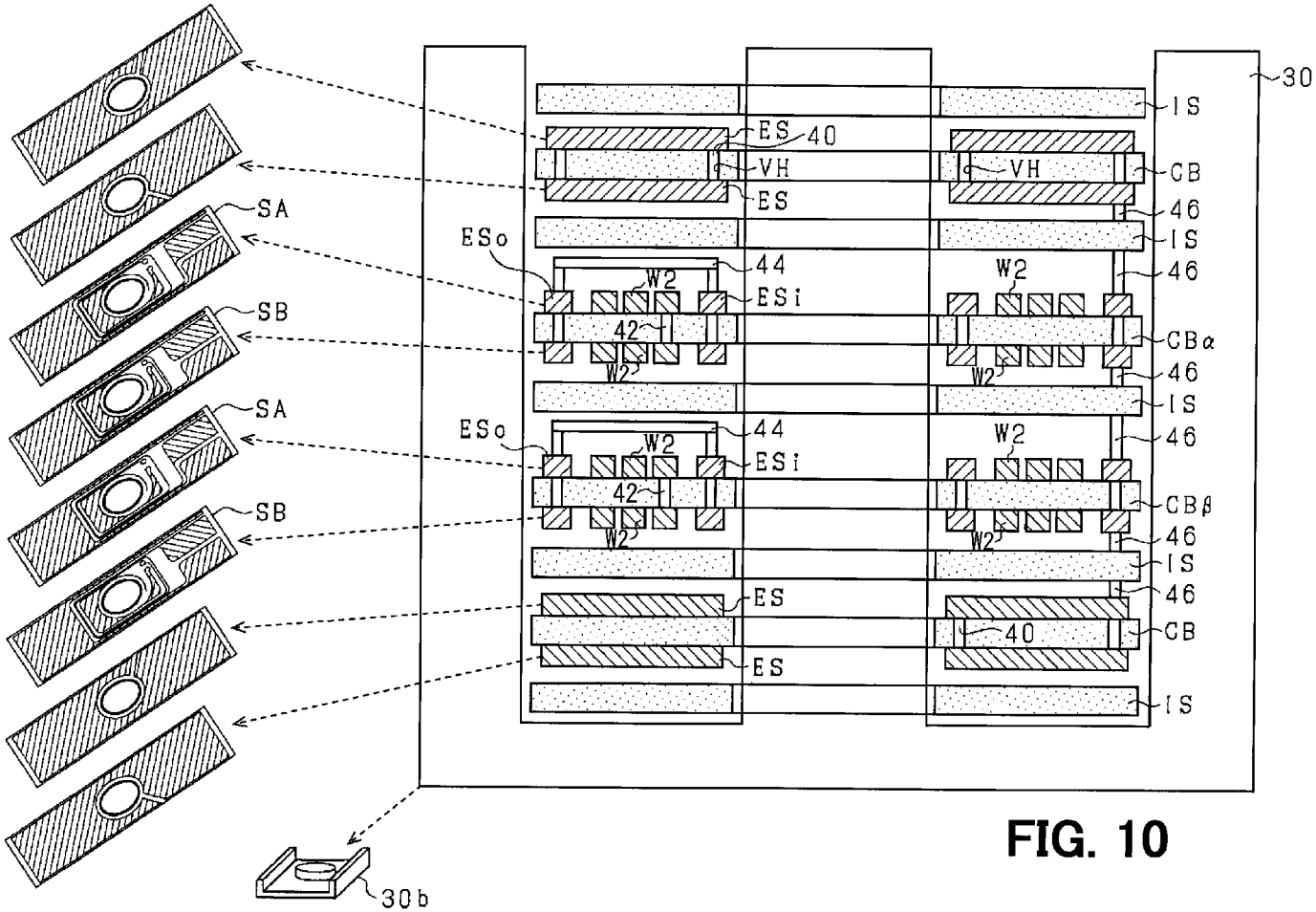
FIG. 10 is a diagram showing a cross-sectional structure of a transformer according to a fifth embodiment of the present disclosure.

In FIG. 10, a part of a transformer T according to the present embodiment corresponding to the secondary coil W2 is illustrated.

Substrates CB, CBα, CBβ are flexible printed substrate having flexibility and are double-sided substrates. In the present embodiment, the substrate CBα is referred to as a first substrate, and the substrate CBβ is referred to as a second substrate. A coil and the like is pattern-formed on each surface of the first substrate CBα and the second substrate CBβ, and the substrates CB, the first substrate CBα and the second substrate CBβ are stacked in such a manner that the first substrate CBα and the second substrate CBβ are disposed between a pair of substrates CB.

Figure 11:
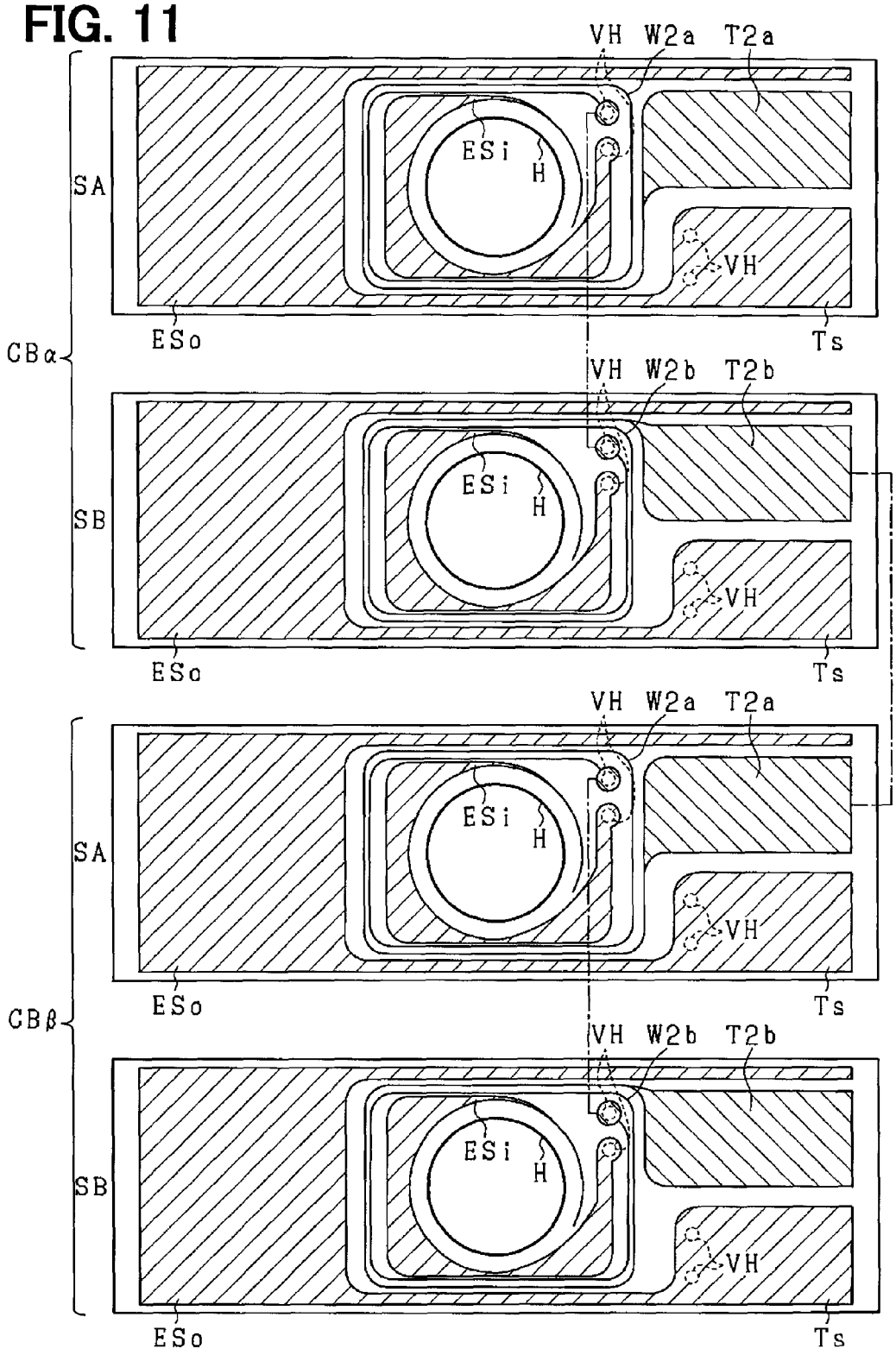
FIG. 11 is a diagram showing a plan view of each layer in the transformer according to the fifth embodiment.

As shown in FIG. 11, each of the first substrate CBα and the second substrate CBβ has a first surface SA and a second surface SB. In the present embodiment, the pattern formed on the first substrate CBα and the second substrate CBβ are same. Thus, a pattern shape will be described taking for an example the first substrate CBα. In FIG. 11, components corresponding to the components shown in FIG. 3 are indicated by the same reference mark for the sake of convenience.

In each of the first substrate CBα and the second substrate CBβ, the second surface SB shown in FIG. 11 is a projection of the pattern shape of the second surface SB on the first surface SA.

As shown in FIG. 11, the first substrate CBα has a rectangular shape in a plane. At an end portion of the first surface SA of the first substrate CBα, a first terminal T2*a* is pattern-formed. In addition, on the first surface SA, a first coil W2*a* is pattern-formed. One end of the first coil W2*a* is connected with the first terminal T2*a* and the first coil W2*a* circles around the hole H.

On a second surface SB of the first substrate CBα, a second terminal T2*b* is pattern-formed at a region that overlaps a region defined by projecting the first terminal T2*a* onto the second surface SB. In addition, on the second surface SB, a pattern is formed at a portion that is connected with the other end of the first coil W2*a*, which is opposite from the end connected with the first terminal T2*a*, through a conductor filling in a via VH. Furthermore, a second coil W2*b* is pattern-formed on the second surface SB. The second coil W2*b* connects the above-described connected portion and the second terminal T2*b* and circles around the hole H. In a case where the first coil W2*a* and the first terminal T2*a* are projected onto the second surface SB, a direction in which the first coil W2*a* circles around the hole H from the first terminal T2*a* is opposite from a direction in which the second coil W2*b* circles around the hole H from the second terminal T2*b*.

In each of the first substrate CBα and the second substrate CBβ, one end of the outer peripheral shield ESo is connected with a shield terminal Ts. In each of the first substrate CBα and the second substrate CBβ, when the shield terminal Ts on one surface is projected onto the other surface, the shield terminals Ts overlap each other. In addition, as shown in FIG. 10, in the present embodiment, an insulation sheet IS is disposed between adjacent substrates. The insulation sheet IS is an insulation layer made of, for example, a polyimide layer or a photo solder resist layer. However, on the first surface SA of the first substrate CBα, the insulation sheet IS is not formed on the first terminal T2*a* and the shield terminal Ts. In addition, on the second surface SB, the insulation sheet is not formed on the second terminal T2*b* and the shield terminal Ts. This is because the first terminal T2*a* and the second terminal T2*b* are used as a pair of pads (or taps) connected with an external device.

Next, a method of stacking the first substrate CBα and the second substrate CBβ will be described.

In the present embodiment, the first substrate CBα and the second substrate CBβ are stacked in such a manner that the second terminal T2*b* formed on the second surface SB of the first substrate CBα is connected with the first terminal T2*a* formed on the first surface SA of the second substrate CBβ. According to the above-described stacking method, the secondary coil W2 is formed of the first coil W2*a* and the second coil W2*b* formed on the first substrate CBα and the first coil W2*a* and the second coil W2*b* formed on the second substrate CBβ. Thus, the number of turns of the secondary coil W2 can be increased. In addition, the first terminal T2*a* of the first substrate CBα and the second terminal T2*b* of the second substrate CBβ can be used as a pair of pads to be connected with an external device.

Furthermore, in each of the first substrate CBα and the second substrate CBβ, in a case where the shield terminal Ts on one surface is projected onto the other surface, the shield terminals Ts overlap each other. Thus, when the first substrate CBα and the second substrate CBβ are stacked, all the shield terminals Ts of the first substrate CBα and the second substrate CBβ can be shortened out.

Figure 12A:
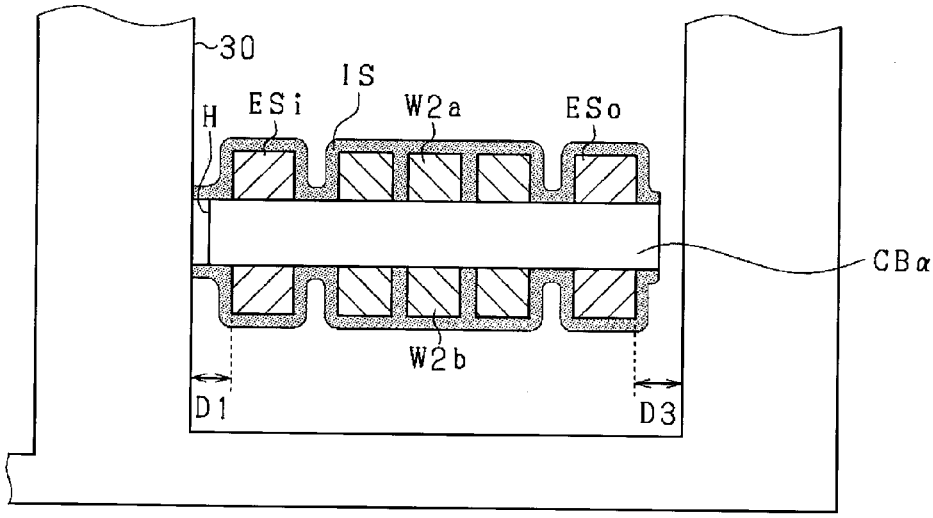
FIG. 12A and FIG. 12B are diagrams for explaining effects of a configuration according to the fifth embodiment.
Figure 12B:
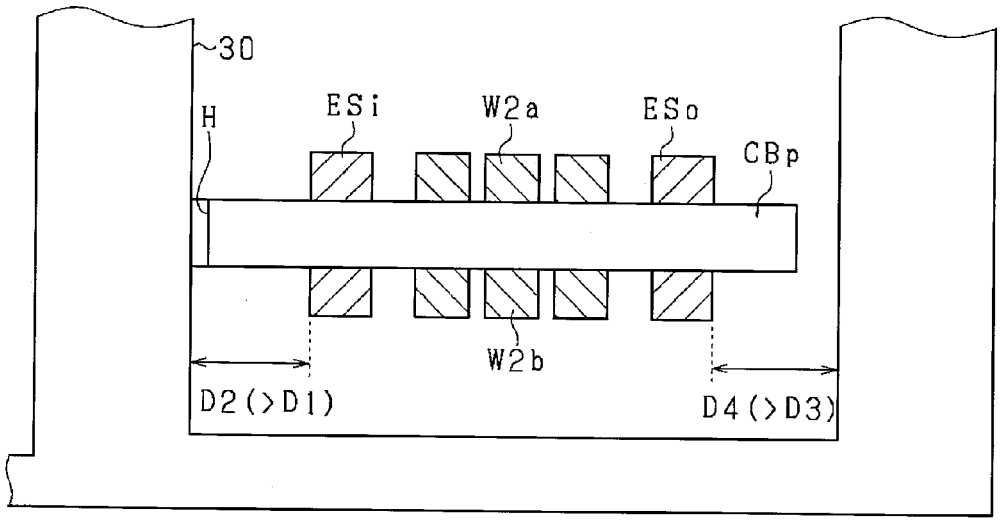

In the present embodiment in which the insulation sheets IS are provided to the flexible printed boards, a creepage distance D1 between the inner peripheral shield ESi located innermost of a surface of the first substrate CBα and the magnetic core 30, which is shown in FIG. 12A, can be shorter than a creepage distance D2 between the inner peripheral shield ESi located innermost of a surface of a rigid substrate CBp and the magnetic core 30, which is shown in FIG. 12B. Furthermore, a creepage distance D3 between the outer peripheral shield ESo located outermost of the surface of the first substrate CBα and the magnetic core 30 can be shorter than a creepage distance D4 between the outer peripheral shield ESo located outermost of the surface of the rigid substrate CBp and the magnetic core 30. This is because the insulation sheet IS formed on the flexible printed board can be thinner than an insulator formed on the rigid substrate CBp. Accordingly, a size of the transformer T can be reduced. In FIG. 12, the insulation sheet IS formed on the lowest layer of the substrate is not illustrated. When the insulator is formed on the rigid substrate CBp, the thickness of the rigid substrate CBp increases. In order to reduce the thickness, a creepage distance at an end portion of the rigid substrate CBp is increased to secure insulation between a shield and the magnetic core 30.

In addition, in the present embodiment, the substrates CB, CBα, CBβ have rectangular shape. Accordingly, the substrates CB, CBα, CBβ can be easily shaped, and the magnetic core 30 can be easily attached to the substrates CB, CBα, CBβ having rectangular shapes. Thus, the number of process in a manufacturing process of the transformer T can be reduced.

Sixth Embodiment

A sixth embodiment of the present disclosure will be described with reference to FIG. 13 with a focus on differences from the fifth embodiment.

In the present embodiment, shapes of patterns formed on flexible printed boards are different from the shapes of the patterns formed on the flexible printed boards according to the fifth embodiment.

Figure 13:
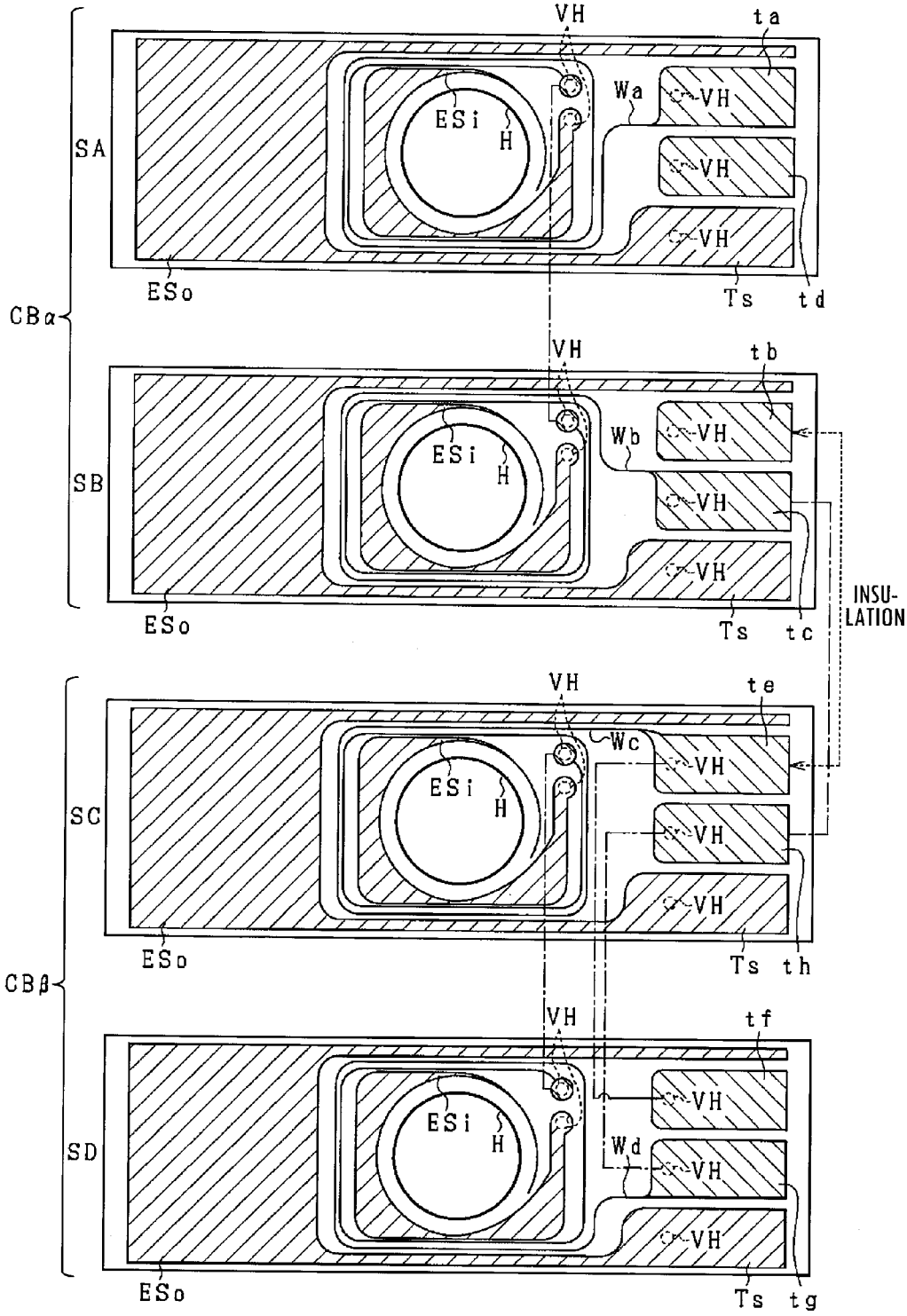
FIG. 13 is a diagram showing a part of a transformer according to a sixth embodiment of the present disclosure.

In FIG. 13, a part of a transformer T according to the present embodiment corresponding to the secondary coil W2 is illustrated. In FIG. 13, components corresponding to the components shown in FIG. 11 are indicated by the same reference mark for the sake of convenience.

In the present embodiment, one surface of the first substrate CBα is referred to as a first surface SA and the other surface of the first substrate CBα is referred to as a second surface SB, one surface of the second substrate CBβ is referred to as a third surface SC, and the other surface of the second substrate CBβ is referred to as a fourth surface SD. The second surface SB of the first substrate CBα in FIG. 13 shows a shape of the second surface SB projected onto the first surface SA. The fourth surface SD of the second substrate CBβ in FIG. 13 shows a shape of the second surface SB projected onto the first surface SA.

As shown in FIG. 13, in the present embodiment, a pattern shape of the first substrate CBα is different from a pattern shape of the second substrate CBβ.

In the first substrate CBα, a first terminal ta is pattern-formed at an end portion of the first surface SA, and a first coil Wa is pattern-formed on the first surface SA. An end of the first coil Wa is connected with the first terminal ta, and the first terminal ta circles around the hole H.

In a region of the second surface SB of the first substrate CBα overlapping a region defined by projecting the first terminal ta onto the second surface SB, a second terminal tb is pattern-formed. The second terminal tb is connected with the first terminal tb through a conductor filling in a via VH. At an end portion of the second surface SB, a third terminal tc is pattern-formed. Furthermore, on the second surface SB, a portion is connected with the other end of the first coil Wa, which is opposite from the end of the first coil Wa connected with the first terminal ta, through a conductor filling in a via VH. In addition, on the second surface SB, the second coil Wb is pattern-formed. The second coil Wb connects the above-described connected portion and the third terminal tc and circles around the hole H. In a case where the first coil Wa and the first terminal ta are projected onto the second surface SB, a direction in which the first coil Wa circles around the hole H from the first terminal ta is opposite from a direction in which the second coil Wb circles around the hole H from the third terminal tc.

In a region of the first surface SA overlapping a region defined by projecting the third terminal tc onto the first surface SA, a fourth terminal td is pattern-formed. The forth terminal td is connected with the third terminal tc through a conductor filling in a via VH.

Next, the second substrate CBβ will be described.

As shown in FIG. 13, at an end portion of the third surface SC of the second substrate CBβ, which is a surface facing the second surface SB of the first substrate CBα, a fifth terminal to is pattern-formed. On the third surface SC, a third coil We is pattern-formed. The third coil We circles around the hole H. One end of the third coil Wc is connected with the fifth terminal te. In a case where the first coil Wa and the first terminal ta are projected onto the second surface SB, a direction in which the first coil Wa circles around the hole H from the first terminal ta is opposite from a direction in which the third coil Wc circles around the hole H from the fifth terminal te.

In a region of the fourth surface SD of the second substrate CBβ overlapping a region defined by projecting the fifth terminal te onto the fourth surface SD, a sixth terminal tf is pattern-formed. The sixth terminal tf is connected with the fifth terminal te through a conductor filling in a via VH. At an end portion of the fourth surface SD, a seventh terminal tg is pattern-formed. Furthermore, on the fourth surface SD, a portion is connected with the other end of the third coil Wc, which is opposite from the end of the third coil Wc connected with the fifth terminal te, through a conductor filling in a via VH. In addition, on the fourth surface SD, a fourth coil Wd is pattern-formed. The fourth coil Wd connects the above-described connected portion and the seventh terminal tg and circles around the hole H. In a case where the third coil Wc and the fifth terminal te are projected onto the fourth surface SD, a direction in which the third coil Wc circles around the hole H from the fifth terminal te is opposite from a direction in which the fourth coil Wd circles around the hole H from the seventh terminal tg.

In a region of the third surface SC overlapping a region defined by projecting the seventh terminal tg onto the third surface SC, an eighth terminal th is pattern-formed. The eighth terminal th is connected with the seventh terminal tg through a conductor filling in a via VH.

On the surfaces of each of the first substrate CBα and the second substrate CBβ, and insulation sheet IS is basically formed. However, on the first surface SA of the first substrate CBα, the insulation sheet IS is not formed on the first terminal ta, the fourth terminal td, and the shield terminal Ts. On the second surface SB of the first substrate CBα, the insulation sheet IS is not formed on the third terminal tc and the shield terminal Ts. On the third surface SC of the second substrate CBβ, the insulation sheet IS is not formed on the eighth terminal th and the shield terminal Ts. On the fourth surface SD of the second substrate CBβ, the insulation sheet IS is not formed on the sixth terminal tf and the shield terminal Ts. Thus, the second terminal tb is electrically insulated from the fifth terminal te.

Next, a stacking method of the first substrate CBα and the second substrate CBβ will be described.

As shown in FIG. 13, in the present embodiment, the first substrate CBα and the second substrate CBβ are stacked in such a manner that the third terminal tc and the eighth terminal th are connected. By disposing the insulation sheet IS, the second terminal tb and the fifth terminal to are insulated from each other. Also by the above-described stacking method, the number of turns of the secondary coil W2 can be increased. In the present case, the first terminal ta of the first substrate CBα and the sixth terminal tf of the second substrate CBβ can be used as a pair of pads to be connected with an external device.

Seventh Embodiment

A seventh embodiment of the present disclosure will be described with reference to FIG. 14 with a focus on differences from the sixth embodiment.

In the present embodiment, a stacking method of the first substrate CBα and the second substrate CBβ are changed from the stacking method according to the sixth embodiment so as to increase the maximum current that can be supplied to the secondary coil W2.

Figure 14:
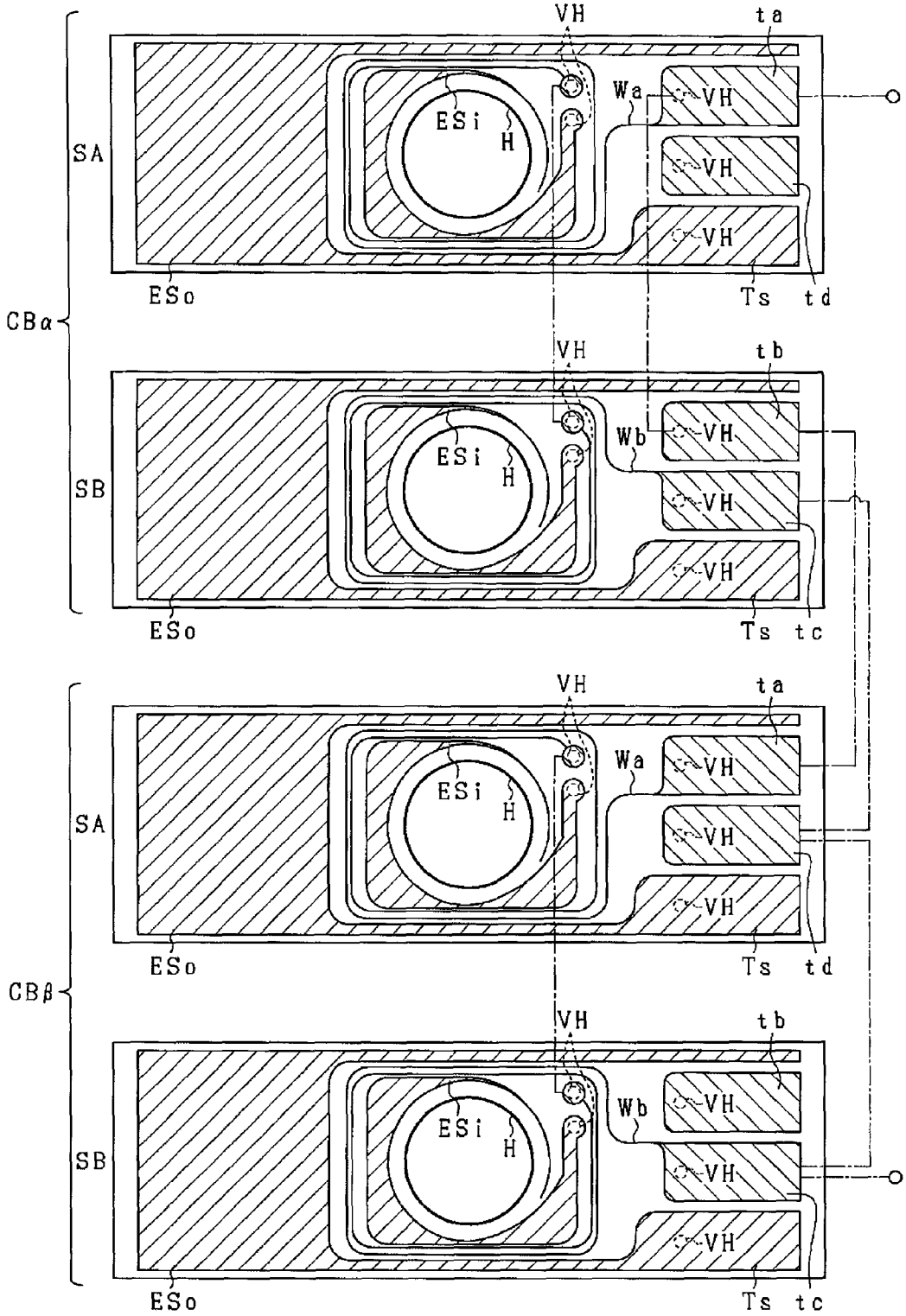
FIG. 14 is a diagram showing a part of a transformer according to a seventh embodiment of the present disclosure.

In FIG. 14, a part of a transformer T according to the present embodiment corresponding to the secondary coil W2 is illustrated. In FIG. 14, components corresponding to the components shown in FIG. 13 are indicated by the same reference mark for the sake of convenience.

As shown in FIG. 14, a second substrate CBβ according to the present embodiment has the same pattern shape as the first substrate CBα shown in FIG. 13. In the present embodiment, in each of the first substrate CBα and the second substrate CBβ, the insulation sheet IS is not formed on the first terminal ta to the fourth terminal td.

The first substrate CBα and the second substrate CBβ are stacked in such a manner that the third terminal tc of the first substrate CBα is connected with the fourth terminal Td of the second substrate CBβ, and the second terminal tb of the first substrate CBα is connected with the first terminal ta of the second substrate CBβ. In other words, the secondary coil W2 is formed as a parallel-connection body of a series-connection body of the first coil Wa and the second coil Wb formed on the first substrate CBα and a series-connection body of the first coil Wa and the second coil Wb formed on the second substrate CBβ. Accordingly, the maximum current that is allowed to flow to the secondary coil W2 can be increased using one kind of substrate.

Eighth Embodiment

An eighth embodiment of the present disclosure will be described with reference to FIG. 15 with a focus on differences from the sixth embodiment.

In the present embodiment, an arrangement of a substrate in which the primary coil W1 is formed (hereafter, referred to as a primary substrate) and a substrate in which the secondary coil W2 is formed (hereafter, referred to as a secondary substrate) is changed.

Figure 15:
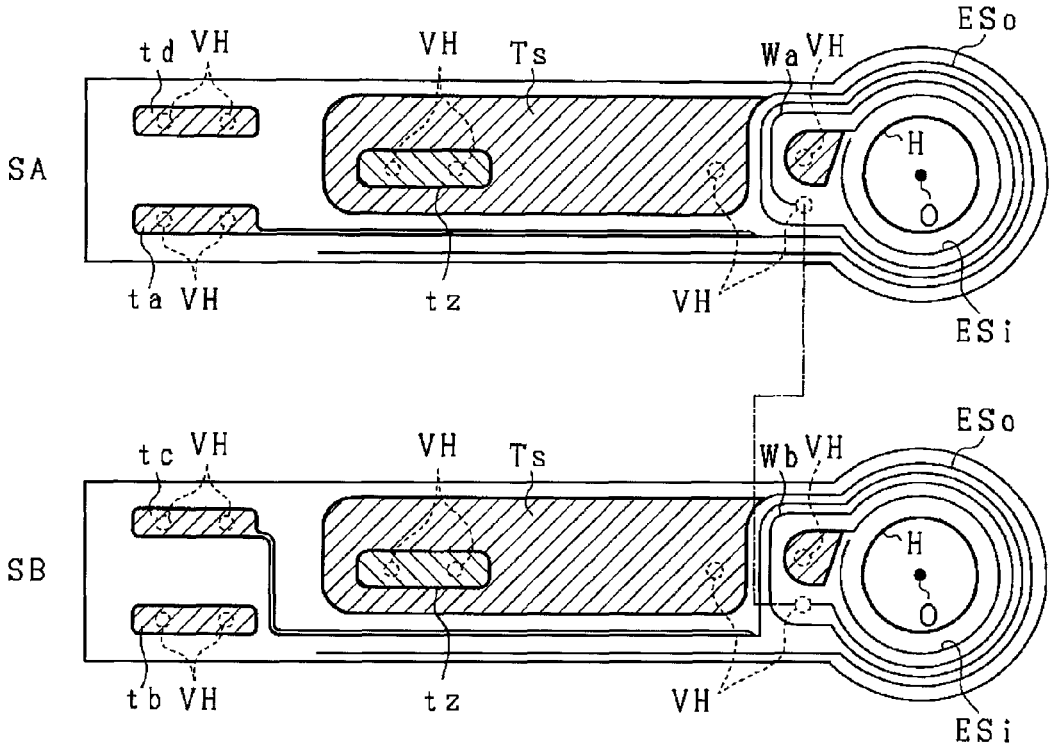
FIG. 15 is a diagram showing plan views of a substrate according to an eighth embodiment of the present disclosure.

FIG. 15 is a diagram showing a plan view of double-sided substrate used in the present embodiment.

In the present embodiment, the same substrate is used as the primary substrate and the secondary substrate, and shapes of the flexible printed substrates are changed. However, a first coil Wa, a second coil Wb, an outer peripheral shield ESo, an inner peripheral shield ESi and the like have similar functions to those described in the sixth embodiment. Thus, in FIG. 5, the first coil Wa, the second coil Wb, the outer peripheral shield ESo, and the inner peripheral shield ESi have the same reference mark as those in FIG. 13. A first surface SA in FIG. 15 corresponds to the first surface SA of the first substrate CBα in FIG. 13, and the second surface SB in FIG. 15 corresponds to the second surface SB of the first substrate CBα in FIG. 13. In FIG. 15, "tz" indicates a terminal for connecting a shield to an external member to be a reference potential (the emitter terminal of the switching element).

Figure 16A:
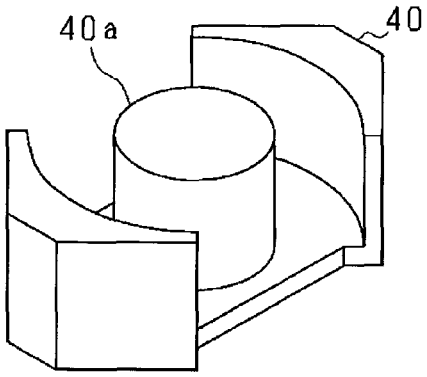
FIG. 16A is a diagram showing a perspective view of a magnetic core according to the eighth embodiment.
Figure 16B:
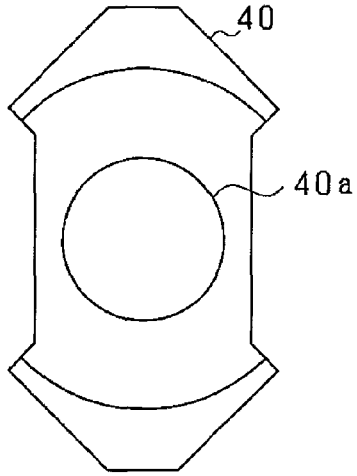
FIG. 16B is a diagram showing a plan view of the magnetic core.

In addition, in the present embodiment, a shape of a magnetic core is changed. FIG. 16A is a perspective view of a magnetic core 40 according to the present embodiment, and FIG. 16B is a plan view of the magnetic core 40. The magnetic core 40 has a center pole 40*a*.

Figure 17:
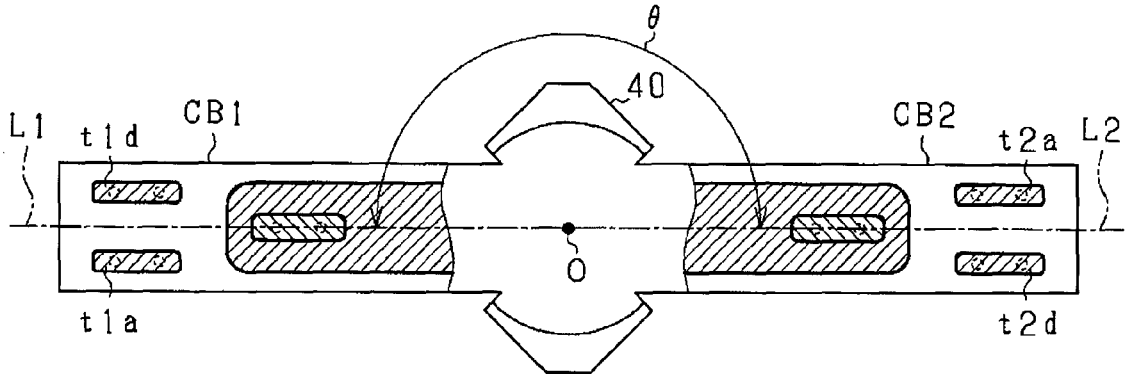
FIG. 17 is a diagram showing an arrangement of substrates according to the eighth embodiment.

An arrangement of a primary substrate CB1 and a secondary substrate CB2 will be described with reference to FIG. 17. In FIG. 17, the primary substrate CB1 and the secondary substrate CB2 are seen from a plane direction. In FIG. 17, portions of the primary substrate CB1 and the secondary substrate CB2 adjacent to the magnetic core 40 are simplified. In addition, in FIG. 17, the first terminal and the fourth terminal of the primary substrate CB1 are respectively indicated by "t1*a*," "t1*d*," and the first terminal and the fourth terminal of the secondary substrate CB2 are respectively indicated by "t2*a*", "t2*d*."

As shown in FIG. 17, in the present embodiment, an axis O of the primary coil W1 formed in the primary substrate CB1 corresponds with an axis O of the secondary coil W2 formed in the secondary substrate CB2. A transformer according to the present embodiment is formed so that an angle between an axis line L1 of the primary substrate CB1 extending in a direction from the axis O of the primary coil W1 to a first terminal t1*a* and an axis line L2 of the secondary substrate CB2 extending in a direction from the axis O of the secondary coil W2 to a first terminal t2*a* is 180 degrees.

According to the above-described configuration, the first terminal and the fourth terminal formed in one of the primary substrate CB1 and the secondary substrate CB2 can be sufficiently separated from the second terminal and the fourth terminal formed in the other of the primary substrate CB1 and the secondary substrate CB2. Thus, an insulation distance between the terminals can be sufficiently secured.

This configuration is made because there is a limitation to dispose the insulation sheet IS on the terminals of the substrate. Thus, on the terminals of the substrates, the insulation sheet IS is normally not disposed in view of connecting with an external device.

Ninth Embodiment

A ninth embodiment of the present disclosure will be described with a focus on differences from the eighth embodiment.

In the present embodiment, a configuration of the transformer T is changed to reduce a leakage flux.

Figure 18A:
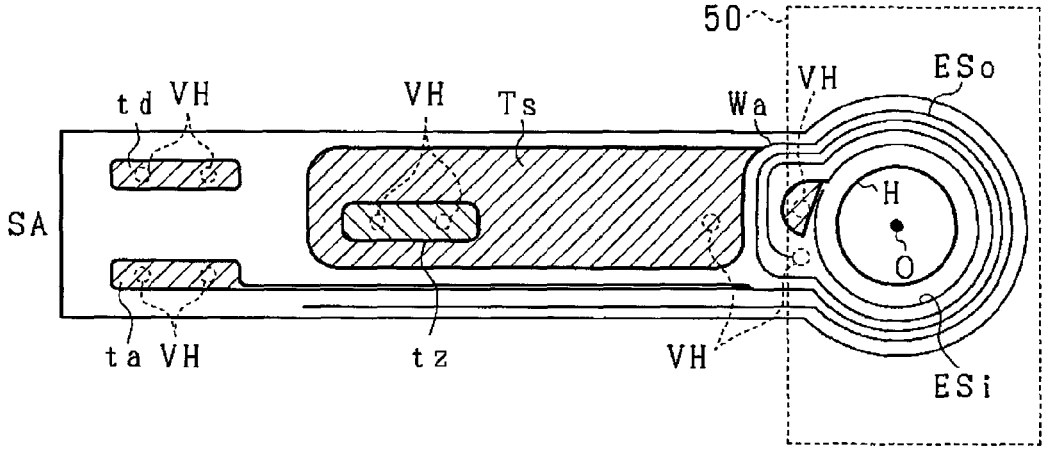
FIG. 18A and FIG. 18B are diagrams showing plan views of a substrate according to a ninth embodiment of the present disclosure.
Figure 18B:
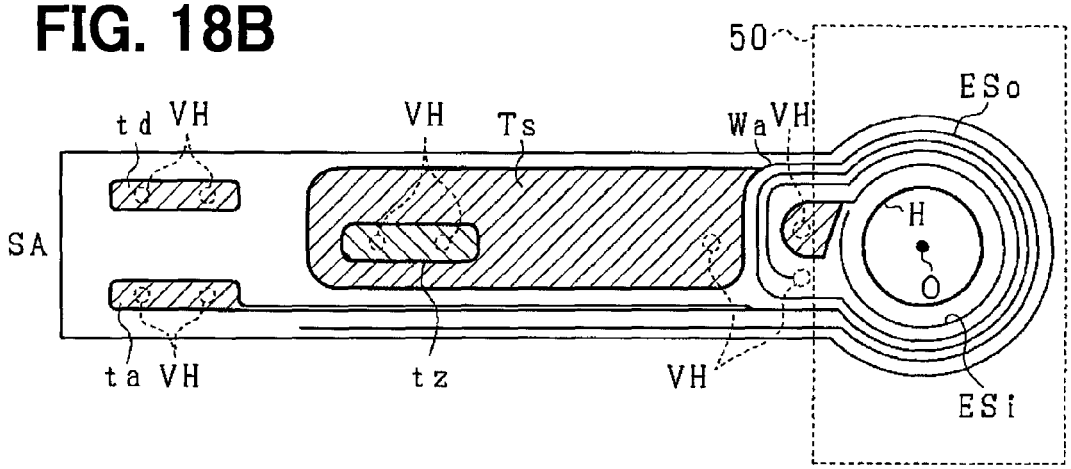

In FIG. 18A and FIG. 18B, a part of a transformer T according to the present embodiment corresponding to the secondary coil W2 is illustrated. Components corresponding to the components shown in FIG. 15 are indicated by the same reference mark for the sake of convenience. The transformer T according to the present embodiment includes a magnetic core 50. An outline of the magnetic core 50 seen from a front of a plane of the substrate is shown by a dashed line. The first terminal ta corresponding to a connection terminal, and a via VH connected with an end of the first coil Wa opposite from first terminal ta corresponds to a connection via.

As shown in FIG. 18A, the transformer T according to the present embodiment is configured so that the via VH connected with the first coil Wa and a via connected with a second coil Wb, which is not shown, are included in a region defined by projecting the magnetic core onto the substrate.

Because the inner peripheral shield ESi is formed on an inner peripheral side of the first coil Wa, the inner peripheral shield ESi and a via VH connected with the inner peripheral shield ESi are also included in the projected region of the magnetic core 50.

According to the present embodiment, the leakage flux can be reduced, and eventually, a reduction of a transmission efficiency of power by the transformer T can be restricted.

Other Embodiments

Each of the above-described embodiments can be modified as follows.

[With Regard to Magnetic Core]

The magnetic core is not limited to the EE core. For example, the magnetic core may have a structure covering a part of only one side of a side surface of the substrate CB.

In another example, a hole penetrated by the magnetic core 30 may be not defined by the substrate between the sixth layer and the seventh layer in FIG. 2, and the magnetic core 30 may sandwich the substrate. Also in the present case, a flow of a displacement current between the primary coil W1 and the secondary coils W2*n*, W2*u*, W2*v*, W2*w* can be restricted.

[With Regard to Structure of Partial Shield]

The stacking structure of the partial shield disposed on one side of the substrate on which the coil is pattern-formed is not limited to a pair of partial shields (the shields ES) having slits at different angles, as shown in FIG. 3 and FIG. 6. For example, a pair of partial shields having two slits may also be used. Also in the present case, when the angles of the slits are different between the partial shields, the coil can be included in a region defined by projecting the partial shields onto the substrate on which the coil is formed. However, on condition that a close loop across the magnetic flux induced by the coil is not formed, a slit is not necessary to include the coil in the region defined by projecting the partial shields onto the substrate on which the coil is formed. In other words, for example, in the configuration shown in FIG. 3, the partial shields (the shields ES) on the first layer and the fifth layer may be formed on only a right region of the substrate CB with respect to a center, and the partial shields on the second layer and the sixth layer may be formed on only a left region of the substrate CB with respect to the center.

The coil may also be included in a region defined by projecting partial shields formed on more than two different layers onto the substrate on which the coil is formed. The above-described structure can be made, for example, by disposing another layer on which a partial shield is formed between the first layer and the second layer so that the primary coil W1 is included in a region defined by projecting the partial shield on the another layer, the partial shield on the first layer, and the partial shield on the second layer onto the third layer.

Figure 20:
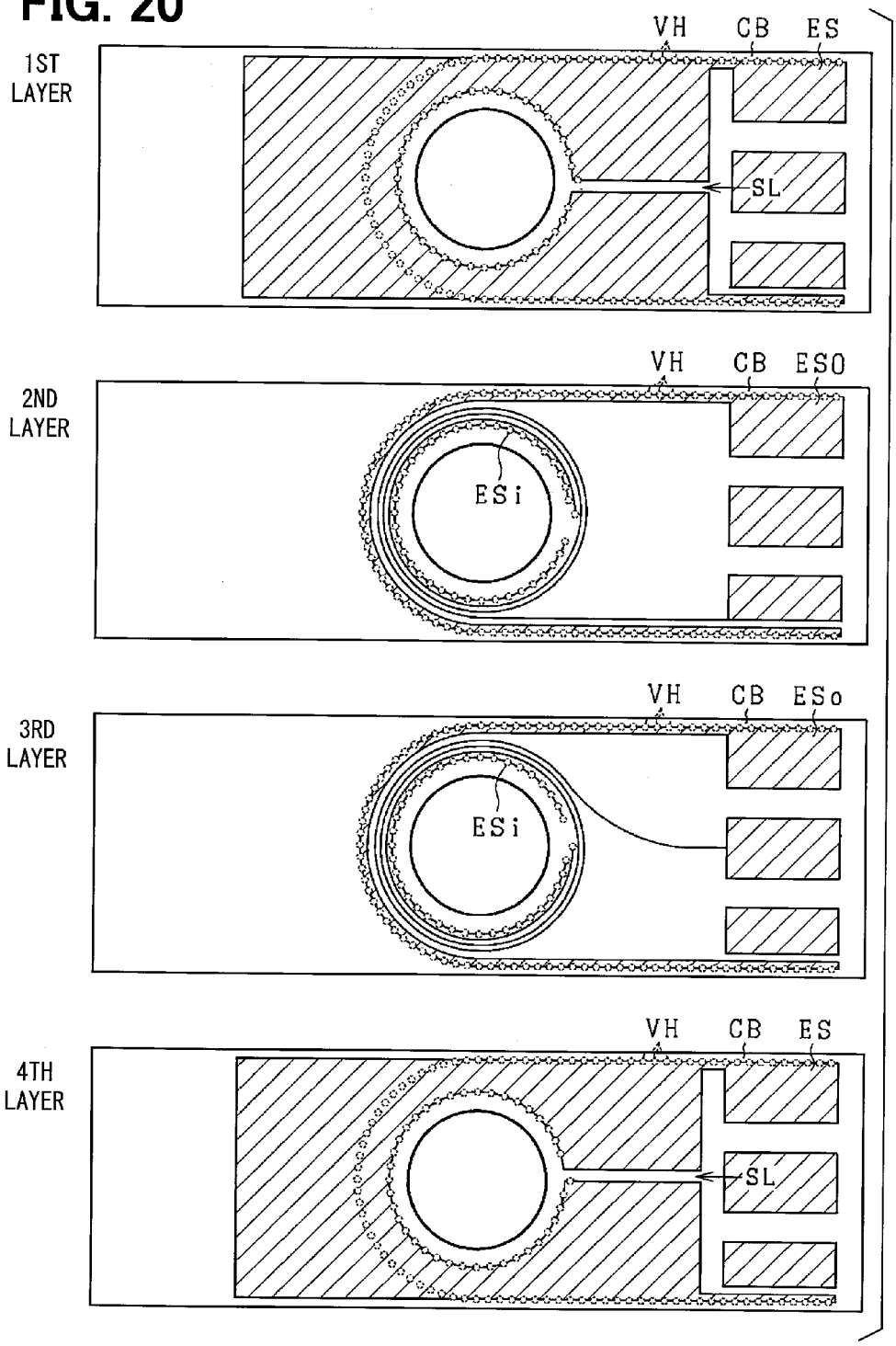
FIG. 20 is a diagram showing a plan view of patterns in a transformer according to another modification of the ninth embodiment.

Furthermore, the shield formed on one side of the substrate on which the coil is pattern-formed may not be the stacking structure of the partial shield. For example, as shown in FIG. 20, the partial shield formed on one layer may be a single layer. In FIG. 20, positions of slits in the partial shield formed on one substrate (the shield ES on the first layer) and the partial shield formed on another layer (the shield ES on the fourth layer) are different from each other so that the coil is included in a region defined by projecting the shields onto the substrate on which the coil is formed.

[With Regard to Shield]

The shield having the stacking structure with the coil, which is pattern-formed, is not limited to the stacking structure of the partial shields. Even when the shield is formed on a single layer, the shielding effect can be improved by reducing an area of the slit SL.

[With Regard to Coil]

The coil is not limited to be formed of patterns formed on both surfaces of the substrate. For example, a pattern formed on one surface of the substrate may form one coil, and patterns formed on both surfaces of a plurality of substrates may also form one coil.

[With Regard to Substrate on which Partial Shield is Formed]

The coil may be pattern-formed on only one surface of the substrate CB such as forming the primary coil W1 on only the fourth layer in FIG. 3. In this case, the shield ES may be pattern-formed on the rear surface (the third layer in FIG. 3) of the substrate CB.

[With Regard to Connection Allowable Region]

Figure 22A:
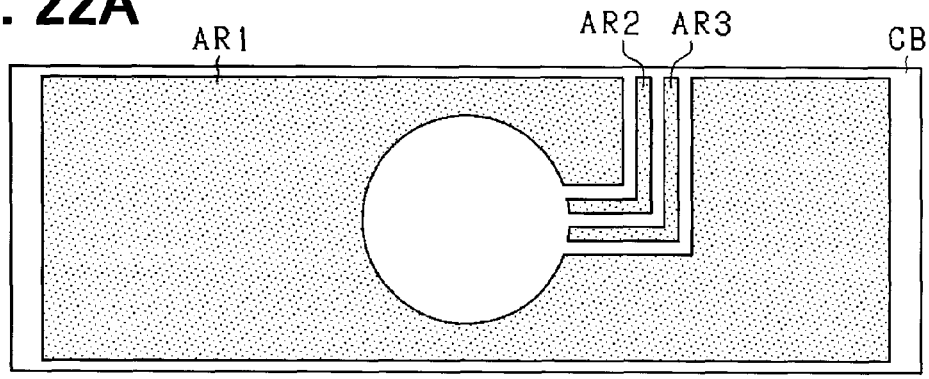
FIG. 22A to FIG. 22D are diagrams showing connection allowable regions according to another modification of the ninth embodiment.
Figure 22B:
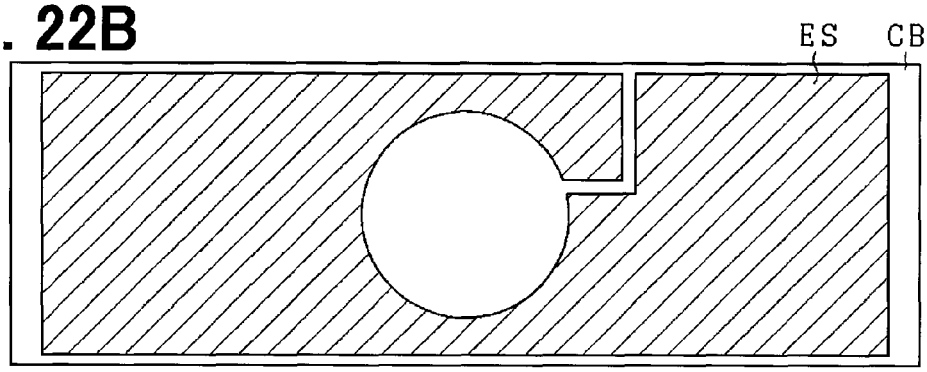
Figure 22C:
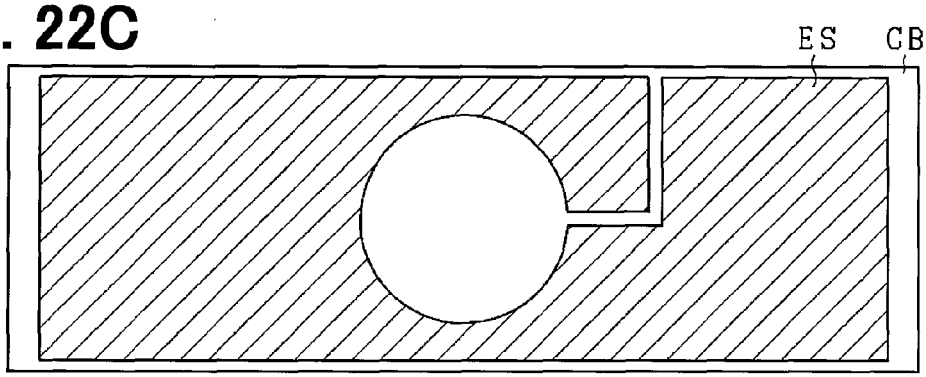
Figure 22D:
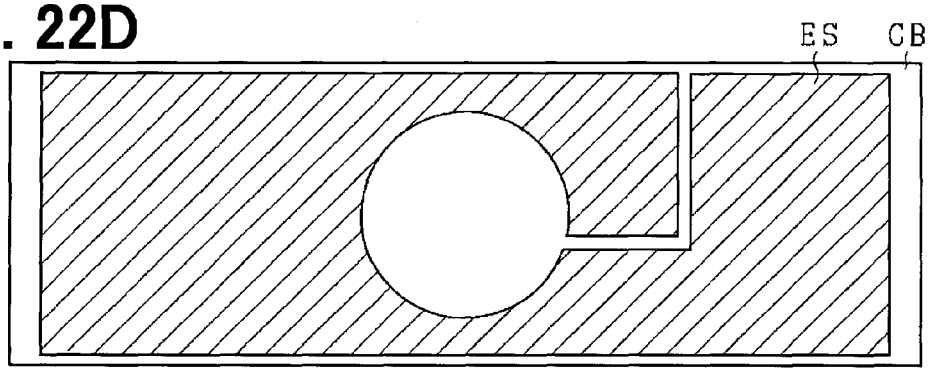

For example, in FIG. 7, the region AR2 in the regions AR1, AR2 divided by projecting the slits SL1, SL2 may be set to a connection allowable region. Depending on the structure of the partials shields, more than two divided regions may be provided. In this case, the connection allowable region may be regions excluding one region. An example of the above-described case is shown in FIG. 22A. Because three partial shields (the shields ES) shown in FIG. 22B to FIG. 22D have slits different from each other, a projected region of the partial shields is divided into three regions AR1, AR2, AR3. Thus, the regions AR1 and AR2 other than the region AR2 may be the connection allowable region, or the regions AR1 and AR3 other than region AR2 may be the connection allowable region.

[With Regard to Inner Peripheral Shield]

Figure 21:
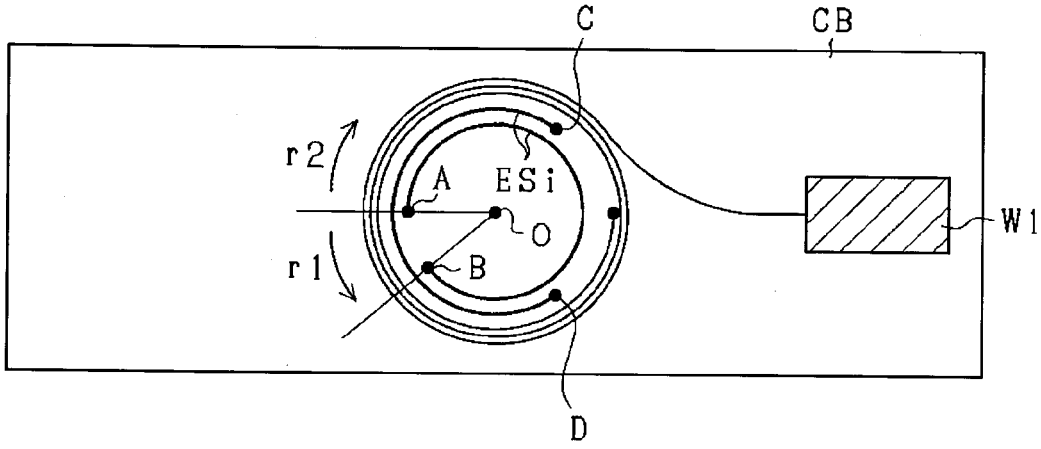
FIG. 21 is a diagram showing an inner peripheral shield according to another modification of the ninth embodiment.

The inner peripheral shield ESi is not limited to the inner peripheral shield ESi shown in FIG. 5 in which the rotation angle from the end portion A to the end portion B of the open loop around the axis O of the coil is greater than 360 degrees. For example, as shown in FIG. 21, a pair of inner peripheral shields in which a rotation angle from one end to the other end is 300 degrees may be disposed in such a manner that an opening portion of one of the inner peripheral shields faces an opening portion of the other of the inner peripheral shields. In this case, when a first half line extending from the axis O to one end portion A of the open loop is rotated so as to overlap a second half line extending from the axis O to the other end portion B, the first half line displaces on the inner peripheral shield ESi in either case where the first half line is rotated in a rotation direction r1 and the first half line is rotated in a rotation direction r2. In other words, in a case where the rotation direction r1 is selected, the first half line displaces on the inner peripheral shield ESi having end portions C, D. In a case where the rotation direction r2 is selected, the first half line displaces on the inner peripheral shield ESi having the end portions A, B.

Figure 19:
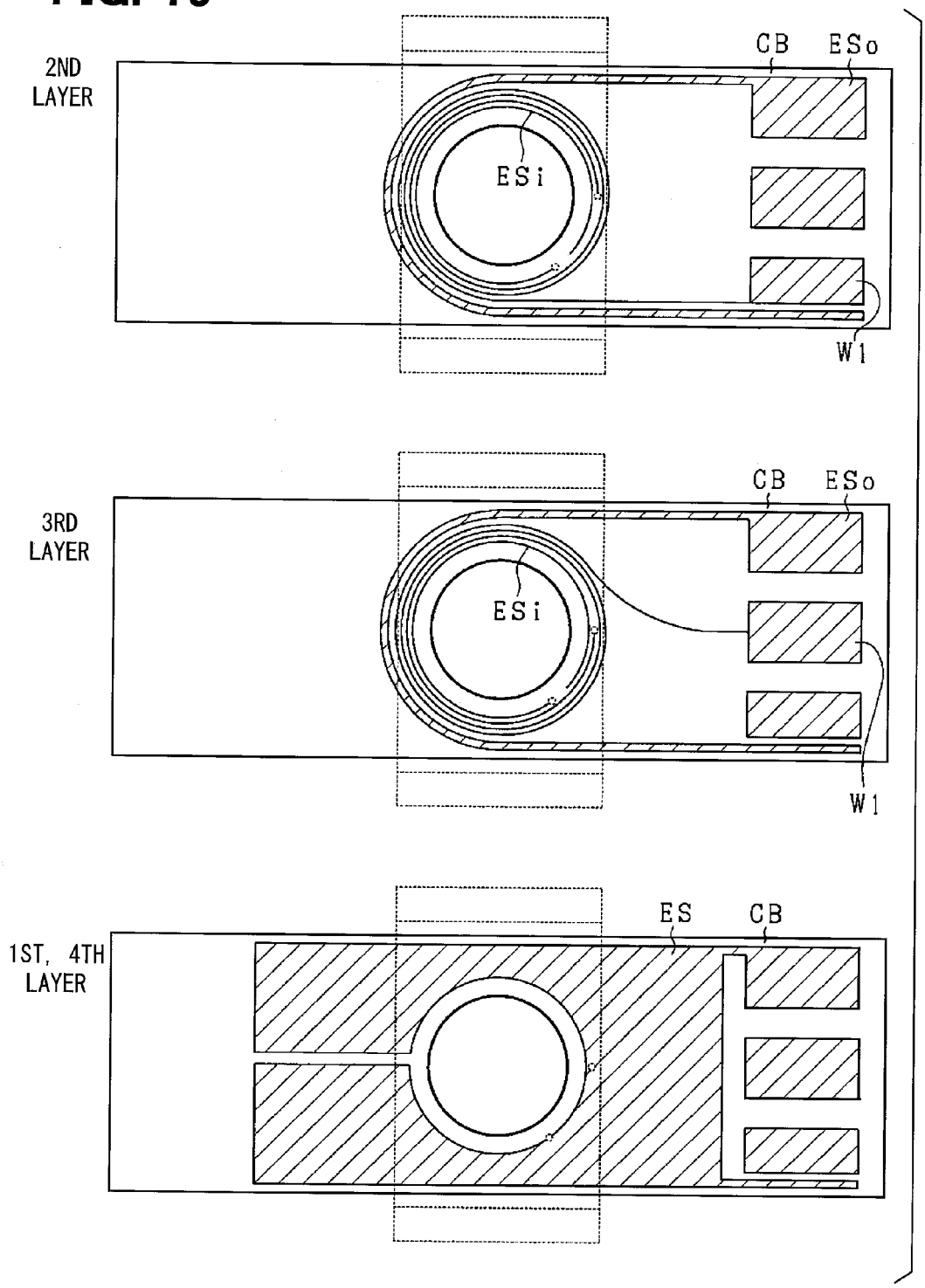
FIG. 19 is a diagram showing a plan view of patterns in a transformer according to a modification of the ninth embodiment.

However, the inner peripheral shield ESi is not limited to have a configuration in which when a first half line extending from an axis to one end portion of an open loop is rotated so as to overlap a second half line extending from the axis to the other end portion of the open loop, the first half line displaces on the inner peripheral shield when the first half line is rotated in either direction. FIG. 19 shows such an example.

[With Regard to Outer Peripheral Shield]

The outer peripheral shield ESo may also be configured in a manner similar to the inner peripheral shield ESi, such that a rotation angle from one end portion to the other end portion around the axis O of the coil is greater than 360 degrees. In this case, a pattern connected with the coil may pass between a pair of end portions so as to be extracted to the end portion of the substrate CB.

[With Regard to Position of Shield]

The shields are not limited to be disposed between the coils. For example, in the example shown in FIG. 1, when the U-phase, the V-phase, and the W-phase have different secondary coils, the reference potentials of the lower arms of all the phase are same. Thus, between secondary coils of the lower arms, the shield may be omitted.

In a case where a flow of a displacement current between a plurality of coils through a magnetic coil can be sufficiently restricted, for example, because the magnetic core has a large resistance, the shield between the magnetic core and the coil may be omitted.

[With Regard to Change of Number of Turns of Coil]

In the fifth embodiment, more than two double-sided substrates in which the coil is formed may be disposed. In the present case, the first terminal and the second terminal formed on a pair of outermost substrates in the stacked double-sided substrates may be used as pads to be connected with external devices.

In the sixth embodiment, two or more pairs of the first substrate CBα and the second substrate CBβ may be stacked. In FIG. 13 in the sixth embodiment, an uppermost substrate of the stacked substrates on which the coil is formed is the first substrate CBα and the second substrate CBβ is stacked under the first substrate CBα. However, the arrangement of the first substrate CBα and the second substrate CBβ is not limited to the above-described example. For example, the upper most substrate may be the second substrate CBβ and the first substrate CBα may be stacked under the second substrate CBβ.

The configuration for changing the number of turns of the coil may also be applied to the primary coil W1 as well as the secondary coil W2.

[With Regard to Angle θ Between Axis Line L1 and Axis Line L2]

In the eighth embodiment, an angle θ between the axis line L1 of the primary substrate CB1 and the axis line L2 of the secondary line CB2 is not limited to 180 degrees and may be greater than 0 degree and less than 180 degrees. Because the insulation distance between the terminal increases with the angle θ from 0 degrees to 180 degrees, the angle θ may be set in accordance with a required insulation distance.

[With Regard to Driven Switching Element]

The driven switching elements are not limited to switching elements that form the inverter INV. For example, the driven switching element may form a converter such as a back-boost chopper circuit.

[With Regard to Usage of Coils]

The coils are not limited to be used for transmitting the operation signals of the driven switching elements and the electric power of the drive circuits of the driven switching elements. For example, the coils may be used for transmitting the electric power and command signals of a monitor process to a state monitoring device in the high voltage battery 12. It should be noted that the transmission of electric power is not necessary. For example, in a case where the changing speed of the switching state of the driven switching element is high, the displacement current may be large. Thus, the application of the present disclosure is effective to restrict the displacement current.

[Others]

The stacking method of the substrates described in the seventh embodiment may be applied to the second substrate CBβ shown in FIG. 13.

The control method of the control amount of the motor generator is not limited to the model predictive control. For example, the control method may also be a known current feedback control in which an operation signal is generated by a triangle wave comparison PWM process so that a command voltage as an operation amount for feeding back an electric current flowing into the motor generator 10 to a command value becomes an output voltage of the inverter INV.

What is claimed is:

1. A magnetic component comprising:

a plurality of coils forming at least one of a primary coil and a secondary coil to which a voltage corresponding to a voltage induced to the primary coil is induced;

a magnetic core penetrating through the coils; and a shield disposed at least one of between different coils in the coils and between one or more of the coils and the magnetic core, wherein:

each of the coils and the shield are respectively pattern-formed on substrates, each of the coils and the shield have a stacking structure, the magnetic component further comprises an insulator, the shield includes a plurality of partial shields that form an open loop around a magnetic path induced by the magnetic core, the partial shields are stacked through the insulator, and a region defined by projecting the partial shields onto the substrate on which one of the coils is formed includes the coil.

2. The magnetic component according to claim 1, further comprising a via filled with a conductor, wherein connection allowable regions are defined by removing a region defined by projecting a region at which the partial shields are not formed onto the substrate on which the coil is formed from the region defined by projecting the partial shields onto the substrate on which the coil is formed so that the region defined by projecting the partial shields onto the substrate on which the coil is formed is divided into a plurality of regions and excluding one region from the plurality of regions, and wherein the connection allowable regions are connected with each other through the via filled with the conductor.

3. The magnetic component according to claim 1, further comprising an inner peripheral shield formed on the substrate on which one of the coils is formed, the inner peripheral shield forming an open loop along an inner periphery of the coil, wherein the inner peripheral shield has such a shape that in a case where a first half line extending from an axis of the coil to one end of the open loop is rotated so as to overlap a second half line extending from the axis of the coil to the other end of the open loop, the first half line displaces over the inner peripheral shield when the first half line is rotated in either direction.

4. The magnetic component according to claim 3, further comprising a via filled with a conductor and provided along the open loop formed by the inner peripheral shield, wherein the shield is formed on the substrate that is different from the substrate on which the coil is formed, and wherein the shield and the inner peripheral shield are connected through the via filled with the conductor.

5. The magnetic component according to claim 1, further comprising an outer peripheral shield disposed on the substrate on which one of the coils is formed, the outer peripheral shield forming an open loop along an outer periphery of the coil.

6. The magnetic component according to claim 5, further comprising a via filled with a conductor and provided along the open loop formed by the outer peripheral shield, wherein the shield is formed on the substrate that is different from the substrate on which the coil is formed, and wherein the shield and the outer peripheral shield are connected through the via filled with the conductor.

7. The magnetic component according to claim 1, further comprising a first terminal and a second terminal, wherein the substrates on which the coils are formed include a substrate having a first surface and a second surface opposite from the first surface, wherein the coils includes a first coil and a second coil, wherein the first coil and the first terminal are pattern-formed on the first surface, the first coil circles around the magnetic core, and the first terminal is connected with one end of the first coil, wherein the second terminal is pattern-formed in a region in the second surface that overlaps a region defined by projecting the first terminal onto the second surface, wherein the second coil is pattern-formed on the second surface, the second coil circles around the magnetic core, and the second coil connects the second terminal and a portion in the second surface connected with the other end of the first coil through a via filled with a conductor, and wherein in a case where the first coil and the first terminal are projected onto the second surface, a direction in which the first coil circles from the first terminal is opposite from a direction in which the second coil circles from the second terminal.

8. The magnetic component according to claim 7, wherein the substrates on which the coils are formed include a plurality of the substrates each having the first surface and the second surface, wherein the substrates each having the first surface and the second surface are stacked in such a manner that, between adjacent substrates, the first terminal formed on one substrate is connected with the second terminal formed on the other substrate.

9. The magnetic component according to claim 1, further comprising a first terminal, a second terminal, a third terminal, and a fourth terminal, wherein the substrates on which the coils are formed include a substrate having a first surface and a second surface opposite from the first surface, wherein the coils include a first coil and a second coil, wherein the first coil and the first terminal are pattern-formed on the first surface, the first coil circles around the magnetic core, and the first terminal is connected with one end of the first coil, wherein the second terminal is pattern-formed in a region in the second surface that overlaps a region defined by projecting the first terminal onto the second surface, and the second terminal is connected with the first terminal through a via filled with a conductor, wherein the second coil and the third terminal are pattern-formed on the second surface, the second coil circles around the magnetic core, the second coil connects the third terminal and a portion in the second surface connected with the other end of the first coil through a via filled with a conductor, wherein in a case where the first coil and the first terminal are projected onto the second surface, a direction in which the first coil circles from the first terminal is opposite from a direction in which the second coil circles from the third terminal, and wherein the fourth terminal is pattern-formed in a region in the first surface that overlaps a region defined by projecting the third terminal onto the first surface, and the fourth terminal is connected with the third terminal through a via filled with a conductor.

10. The magnetic component according to claim 9, further comprising a fifth terminal, a sixth terminal, a seventh terminal, and an eighth terminal, wherein the substrate having the first surface and the second surface is a first substrate, wherein the substrates on which the coils are formed further include a second substrate having a third surface and a fourth surface, wherein the first substrate and the second substrate are stacked in such a manner that the second surface faces the third surface, wherein the coils further include a third coil and a fourth coil, wherein the third coil and the fifth terminal are pattern-formed on the third surface, the third coil circles around the magnetic core, and the fifth terminal is connected with one end of the third coil, wherein in a case where the first coil and the first terminal are projected onto the third surface, a direction in which the first coil circles from the first terminal is opposite from a direction in which the third coil circles from the fifth terminal, wherein the sixth terminal is pattern-formed in a region in the fourth surface that overlaps a region defined by projecting the fifth terminal onto the fourth surface, and the sixth terminal is connected with the fifth terminal through a via filled with a conductor, wherein the fourth coil and the seventh terminal are pattern-formed on the fourth surface, the fourth coil circles around the magnetic core, and the fourth coil connects the seventh terminal and a portion in the fourth surface connected with the other end of the fifth terminal through a via filled with a conductor, wherein in a case where the third coil and the fifth terminal are projected onto the fourth surface, a direction in which the third coil circles from the fifth terminal is opposite from a direction in which the fourth coil circles from the seventh terminal, wherein the eighth terminal is pattern-formed in a region in the third surface that overlaps a region defined by projecting the seventh terminal onto the third surface, and the eighth terminal is connected with the seventh terminal through a via filled with a conductor, and wherein the third terminal is connected with the eighth terminal, and the second terminal is insulated from the fifth terminal.

11. The magnetic component according to claim 9, wherein the substrates on which the coils are formed include a plurality of the substrates each having the first surface and the second surface, wherein the substrates each having the first surface and the second surface are stacked in such a manner that, between adjacent substrates, the first terminal formed on one substrate is connected with the second terminal formed on the other substrate, and the fourth terminal formed on the one substrate is connected with the third terminal formed on the other substrate.

12. The magnetic component according to claim 7, further comprising at least one of an inner peripheral shield and an outer peripheral shield disposed on each surface of the substrate, the inner peripheral shield forming an open loop along an inner periphery of the coil, the outer peripheral shield forming an open loop along an outer periphery of the coil, and a shield terminal disposed on each surface of the substrate and connected with the at least one of the inner peripheral shield and the outer peripheral shield, wherein in a case where the shield terminal disposed on one surface of the substrate is projected onto the other surface, the shield terminal overlaps the shield terminal disposed on the other surface.

13. The magnetic component according to claim 1, wherein the coils form the primary coil formed on a primary substrate and the secondary coil formed on a secondary substrate, wherein a terminal connected with the primary coil is pattern-formed at an end portion of the primary substrate, wherein a terminal connected with the secondary coil is pattern-formed at an end portion of the secondary substrate, and wherein in a front view of the primary substrate and the secondary substrate, an angle between an axis line of the primary substrate extending from an axis of the primary coil to the terminal connected with the primary coil and an axis line of the secondary substrate extending from an axis of the secondary coil to the terminal connected with the secondary coil is greater than 0 degree.

14. The magnetic component according to claim 1, further comprising a connection terminal and a connection via, wherein the substrates on which the coils are formed include a substrate having a first surface and a second surface, wherein the coils include a first coil and a second coil, wherein the first coil and the connection terminal are pattern-formed on the first surface, the first coil circles around the magnetic core, the connection terminal is connected with one end of the first coil, wherein the connection via is formed in the substrate and connects the other end of the first coil with the second surface, wherein the second coil is formed on the second surface, the second coil circles around the magnetic core, and one end of the second coil is connected with the connection via, wherein the magnetic core sandwiches the substrate, and wherein the connection via is included in a region defined by projecting the magnetic core onto the substrate.

15. The magnetic component according to claim 1, wherein the substrates is a flexible substrate, and wherein the substrate on which the pattern is formed is attached with an insulation layer that covers the pattern.

16. The magnetic component according to claim 1, wherein the substrate has a rectangular shape in a front view.

17. The magnetic component according to claim 1, wherein the magnetic core penetrates through the substrates on which the patterns are formed.

18. The magnetic component according to claim 1, further comprising an output section that outputs an operation signal of a driven switching element, wherein the coils form the primary coil and the secondary coil, and wherein the primary coil is connected with the output section.

19. The magnetic component according to claim 18, further comprising a drive section that drives the driven switching element, wherein a reference potential of the drive section and a reference potential of the output section are different from each other, wherein the shield is disposed between the primary coil and the secondary coil, and wherein the shield includes a primary shield set to the reference potential of the output section and the secondary shield set to the reference potential of the drive section.

20. The magnetic component according to claim 19, wherein the driven switching element includes a high-potential side switching element in a plurality of series-connection bodies connected in parallel with a direct-current source, and wherein each of the series-connection bodies includes the high-potential side switching element and a low-potential side switching element connected in series.

21. A magnetic component comprising:

a plurality of coils forming at least one of a primary coil and a secondary coil to which a voltage corresponding to a voltage induced to the primary coil is induced;

a magnetic core penetrating through the coils; and a shield disposed at least one of between different coils in the coils and between one or more of the coils and the magnetic core, wherein:

each of the coils and the shield are respectively pattern-formed on substrates, each of the coils and the shield have a stacking structure, the magnetic component further comprises an inner peripheral shield formed on the substrate on which one of the coils is formed, the inner peripheral shield forming an open loop along an inner periphery of the coil, and the inner peripheral shield has such a shape that in a case where a first half line extending from an axis of the coil to one end of the open loop is rotated so as to overlap a second half line extending from the axis of the coil to the other end of the open loop, the first half line displaces over the inner peripheral shield when the first half line is rotated in either direction.

* * * * *